US009098012B2

(12) United States Patent
Yamamoto et al.

(10) Patent No.: US 9,098,012 B2
(45) Date of Patent: Aug. 4, 2015

(54) ELECTROPHOTOGRAPHIC IMAGE FORMING APPARATUS AND PROCESS CARTRIDGE

(75) Inventors: Shinya Yamamoto, Numazu (JP); Taku Watanabe, Susono (JP); Yasunori Toriyama, Numazu (JP); Hideki Maeshima, Mishima (JP); Kuniaki Hirukawa, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/571,624

(22) Filed: Aug. 10, 2012

(65) Prior Publication Data

US 2013/0051840 A1 Feb. 28, 2013

(30) Foreign Application Priority Data

Aug. 22, 2011 (JP) ..... 2011-180273
Apr. 23, 2012 (JP) ..... 2012-097654

(51) Int. Cl.
*G03G 15/08* (2006.01)
*G03G 21/00* (2006.01)

(52) U.S. Cl.
CPC ..... *G03G 15/0817* (2013.01); *G03G 15/0898* (2013.01); *G03G 21/0011* (2013.01); *G03G 21/007* (2013.01); *G03G 2221/0015* (2013.01)

(58) Field of Classification Search
CPC ..... G03G 15/0817; G03G 15/0898; G03G 21/0011; G03G 21/007; G03G 2221/0015
USPC ..... 399/102, 350
See application file for complete search history.

(56) References Cited

U.S. PATENT DOCUMENTS 5,404,216 A * 4/1995 Numagami et al. ..... 399/102
6,947,685 B2 9/2005 Arimitsu et al.
7,092,657 B2 8/2006 Nakashima et al.

(Continued)

FOREIGN PATENT DOCUMENTS

CN 101236381 A 8/2008
JP 2001-117329 A 4/2001

(Continued)

OTHER PUBLICATIONS

Search Report in European Patent Application No. 12181114.5, dated Mar. 21, 2014.

(Continued)

*Primary Examiner* — Benjamin Schmitt
(74) *Attorney, Agent, or Firm* — Fitzpatrick, Cella, Harper & Scinto

(57) ABSTRACT

An electrophotographic image forming apparatus for forming an image on a recording material includes an electrophotographic photosensitive member (drum); a developer carrying member; a cleaning blade for cleaning the drum; a developer seal member of a peripheral surface seal type, provided at an end portion of the developer carrying member, for preventing leakage of the developer; and a developer retaining member provided at an end portion of the cleaning blade. With respect to a longitudinal direction of the drum, the developer seal member is disposed in a region where the cleaning blade is provided, an inside end position of the retaining member is located at the same position as or inside an inside end position of the developer seal member, and an outside end position of the retaining member is located at the same position as or outside an outside end position of the developer seal member.

22 Claims, 21 Drawing Sheets

(56) References Cited

U.S. PATENT DOCUMENTS

| | | | | |
|---|---|---|---|---|
| 7,697,879 | B2 | 4/2010 | Watanabe et al. | |
| 7,833,387 | B2 | 11/2010 | Mitsui et al. | |
| 2002/0001489 | A1 * | 1/2002 | Ozaki et al. | 399/298 |
| 2008/0181691 | A1 | 7/2008 | Watanabe et al. | |

FOREIGN PATENT DOCUMENTS

| | | | | | |
|---|---|---|---|---|---|
| JP | 2005-181713 | A | | 7/2005 | |
| JP | 2005194581 | A | | 7/2005 | |
| JP | 2006-201591 | A | | 8/2006 | |
| JP | 2006201591 | A | * | 8/2006 | G03G 21/10 |
| JP | 2006-208550 | A | | 10/2006 | |
| WO | 2011/083871 | A1 | | 7/2011 | |

OTHER PUBLICATIONS

Office Action in Chinese Application No. 2012/10300075.2, dated Jul. 31, 2014.

* cited by examiner

Lcr : 228mm
Lcb : 237mm
Lht(5a) : 220mm
Lsc : 17mm
Le : 250mm
Lt : 222mm
Lsd : 5mm
Lnt : 9mm

Lcr : 228mm
Lcb : 237mm
Lht(5a) : 220mm
Lsc : 17mm
Le : 245mm
Lt : 222mm
Lsd : 5mm
Lnt : 7mm (a)

(b)

(a)

(b)

ELECTROPHOTOGRAPHIC IMAGE FORMING APPARATUS AND PROCESS CARTRIDGE

FIELD OF THE INVENTION AND RELATED ART

The present invention relates to an electrophotographic image forming apparatus and a process cartridge.

Here, the electrophotographic image forming apparatus forms an image on a recording material (e.g., recording paper, OHP sheet, cloth, etc.) by using an electrophotographic image forming system. Examples of the electrophotographic image forming apparatus include, e.g., an electrophotographic copying machine, an electrophotographic printer (such as a laser beam printer or an LED printer), a facsimile machine, and a multi-function machine of these machines (such as a multi-function printer).

Further, the process cartridge is prepared by integrally assembling an electrophotographic photosensitive member with at least one of, as a process means acting on the electrophotographic photosensitive member, a charging means, a developing means and a cleaning means into a cartridge. Further, this cartridge is detachably mountable to a main assembly of the electrophotographic image forming apparatus.

In the electrophotographic image forming apparatus, a contact developing system has been widely used from the viewpoints of reproducibility of a halftone image and suppression of excessive edge effect of an image. The contact developing system refers to a system in which a developer carrying member of the developing means is contacted to the electrophotographic photosensitive member and a latent image formed on the electrophotographic photosensitive member is developed with a developer (toner).

As a constitution of the contact developing system, in order to bring the electrophotographic photosensitive member and the developer carrying member into intimate contact with each other uniformly with respect to a rotational axis direction of the electrophotographic photosensitive member and the developer carrying member, it is in general that one of these members is an elastic member (including a sheet or the like backed up by the elastic member) and the other member is a rigid member. A most simple constitution is such that the electrophotographic photosensitive member is the rigid member and the developer carrying member is the elastic member (developing roller). Particularly, as the process cartridge detachably mountable to the image forming apparatus main assembly, in the case where the process cartridge is constituted so as to include the electrophotographic photosensitive member and the developer carrying member, the process cartridge is used in the above-described combination in many cases.

In the developing roller mounted at an opening provided in a developing device frame of the process cartridge, as a developer seal method at an end portion of the developing roller with respect to the rotational axis direction (hereinafter referred to as a longitudinal direction), a developing roller peripheral surface seal type (method) is used in general.

In this type, the developing roller longer in length than a longitudinal length of the above-described opening is used. Further, in the developing device frame, both end portions provided opposed to the peripheral surface of the developing roller are formed in an arcuate shape and to the both end portions, a seal member such as a fiber-planted material which is a felt material or the like, a pile fabric or Moltopren is bonded. Further, the seal member is pressed against the peripheral surface of the developing roller to seal the developer.

For that reason, a region where the developer is carried (developer coat region) and a region where the developer is not carried (developer non-coat region) are generated on the peripheral surface of the developing roller. Further, as a charging method for electrically uniformly charging the electrophotographic photosensitive member surface, a contact charging method has been widely used. For example, there is a charging roller type in which a charging roller as the elastic member is contacted to the photosensitive member as the rigid member. In the charging roller type, a DC contact charging device for effecting charging by applying a DC voltage has the advantage such that an amount of abrasion (wearing) of the photosensitive member surface (photosensitive member abrasion amount) by deterioration of the photosensitive member surface due to electric discharge and then by contact of a cleaning member is small.

Further, as a means for removing a residual toner remaining on the electrophotographic photosensitive member without contributing to transfer, a means for removing the residual toner by a cleaning blade formed of an elastic material such as a rubber has been widely put into practical use.

In each of both longitudinal end sides of this cleaning blade, a seal means is provided in general. For example, the seal member such as the fiber-planted material which is the felt material or the like, the pile-fabric or Moltopren is contacted to a side surface of the blade or an image bearing member surface in a region other than an image region. As a result, a constitution in which a toner scraped off by the cleaning blade or a toner laterally moved along a blade edge is prevented from being escaped to the outside has already been proposed.

In such an electrophotographic image forming apparatus, a photosensitive member surface abrasion at an end portion of a contact region between the electrophotographic member and the developing roller becomes problematic. In response, the present inventors have proposed an electrophotographic image forming apparatus and a process cartridge as described in U.S. Pat. No. 7,697,879. In this proposal, (developer carrying member length)>(cleaning blade length) is satisfied, whereby the photosensitive member surface abrasion in a region, located longitudinally outside the cleaning blade, in which the electrophotographic photosensitive member and the developing roller contact is suppressed.

However, even when a constitution of (developer carrying member length)>(cleaning blade length) is employed, it was found that the surface abrasion on the photosensitive member in a region opposing a region of the seal member provided at the developing roller end portion occurred conspicuously.

Further, from the viewpoints of downsizing and cost reduction of the electrophotographic image forming apparatus, a developing device and the process cartridge, the constitution of (developer carrying member length)<(cleaning blade length) cannot be necessarily employed in some cases.

Further, also in such a constitution of (cleaning blade length)<(developer carrying member length), it was found that the surface abrasion on the photosensitive member in the region opposing the region of the seal member provided at the developing roller end portion occurred conspicuously.

SUMMARY OF THE INVENTION

A principal object of the present invention is to provide an electrophotographic image forming apparatus and a process cartridge which are capable of suppressing or reducing a photosensitive member surface abrasion described above.

According to an aspect of the present invention, there is provided an electrophotographic image forming apparatus for forming an image on a recording material, comprising: a rotatable electrophotographic photosensitive member on which a latent image is to be formed; a rotatable developer carrying member for carrying a developer and for developing the latent image with the developer in contact to the photosensitive member; a cleaning blade for cleaning the photosensitive member in contact to the photosensitive member; a developer seal member of a peripheral surface seal type, provided at an end portion of the developer carrying member, for preventing leakage of the developer; and a retaining member, provided at an end portion of the cleaning blade, capable of retaining the developer in contact to the photosensitive member, wherein with respect to a longitudinal direction of the photosensitive member, the developer seal member is disposed in a region where the cleaning blade is provided, an inside end position of the retaining member is located at the same position as or inside an inside end position of the developer seal member, and an outside end position of the retaining member is located at the same position as or outside an outside end position of the developer seal member.

These and other objects, features and advantages of the present invention will become more apparent upon a consideration of the following description of the preferred embodiments of the present invention taken in conjunction with the accompanying drawings.

Figure 12:
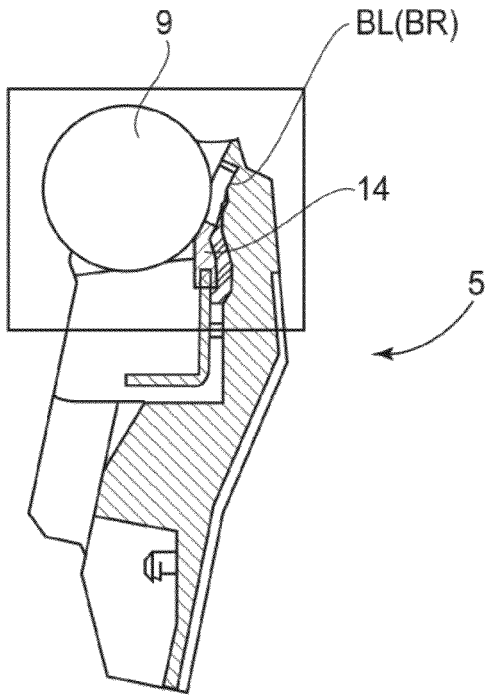
Figure 12:
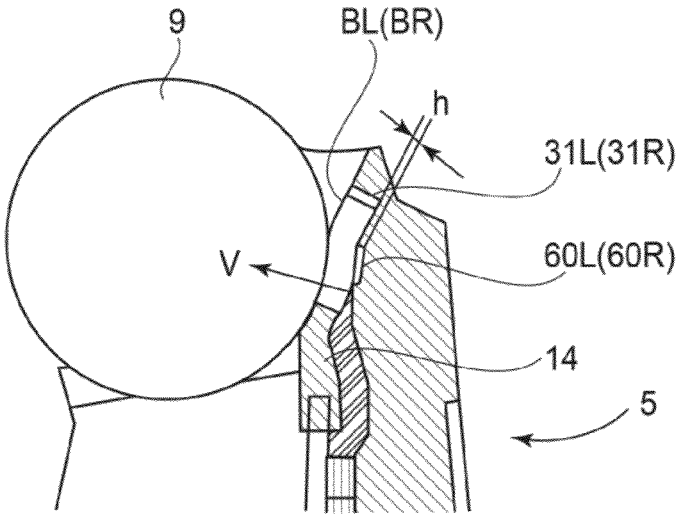

Part (a) of FIG. 12 is a schematic sectional view of a cleaning unit in the present invention, and (b) of FIG. 12 is a detailed view of one longitudinal end portion of (a) of FIG. 12.

Figure 13:
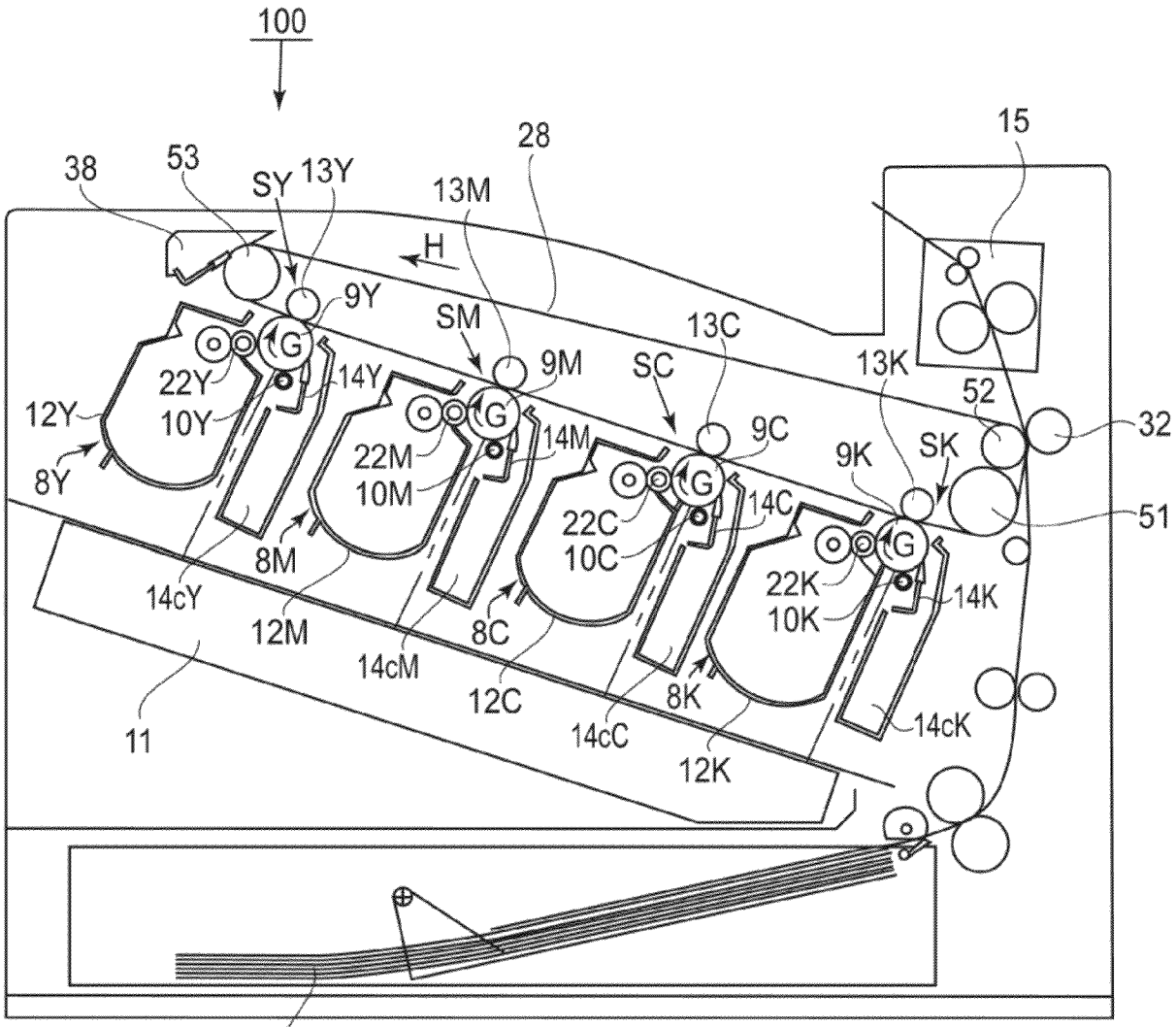

FIG. 13 is a schematic sectional view of an embodiment of an image forming apparatus according to the present invention.

Figure 14:
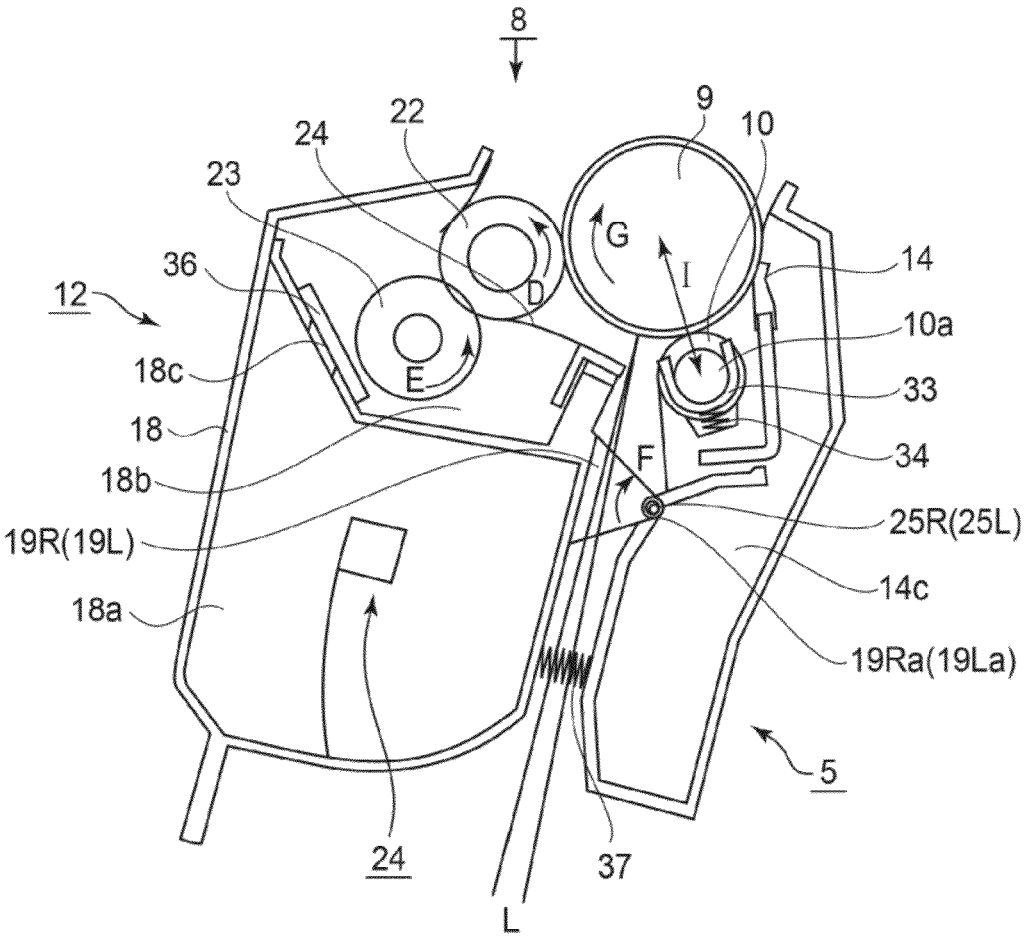

FIG. 14 is a schematic sectional view of a process cartridge according to the present invention.

Figure 15:
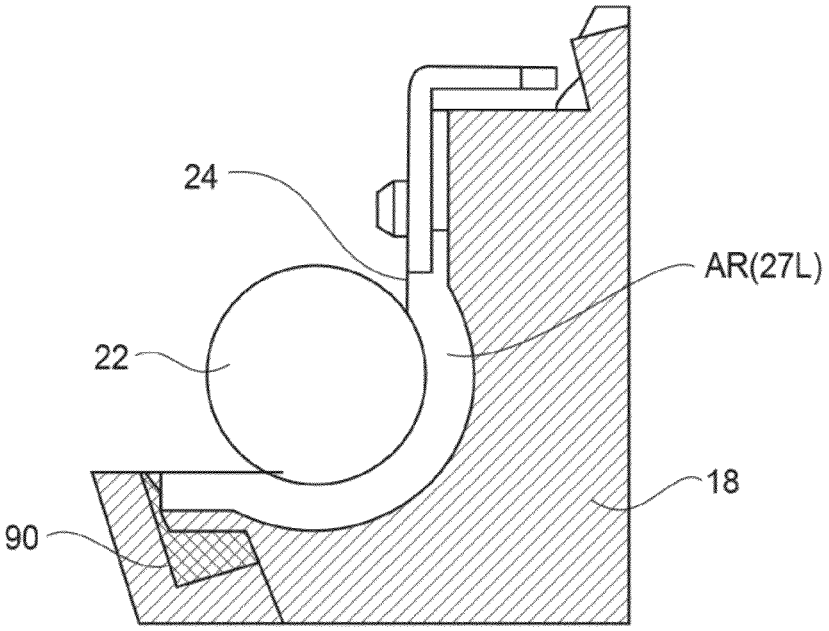

FIG. 15 is a schematic sectional view showing a seal constitution at a developing unit end portion of the process cartridge according to the present invention.

Figure 16:
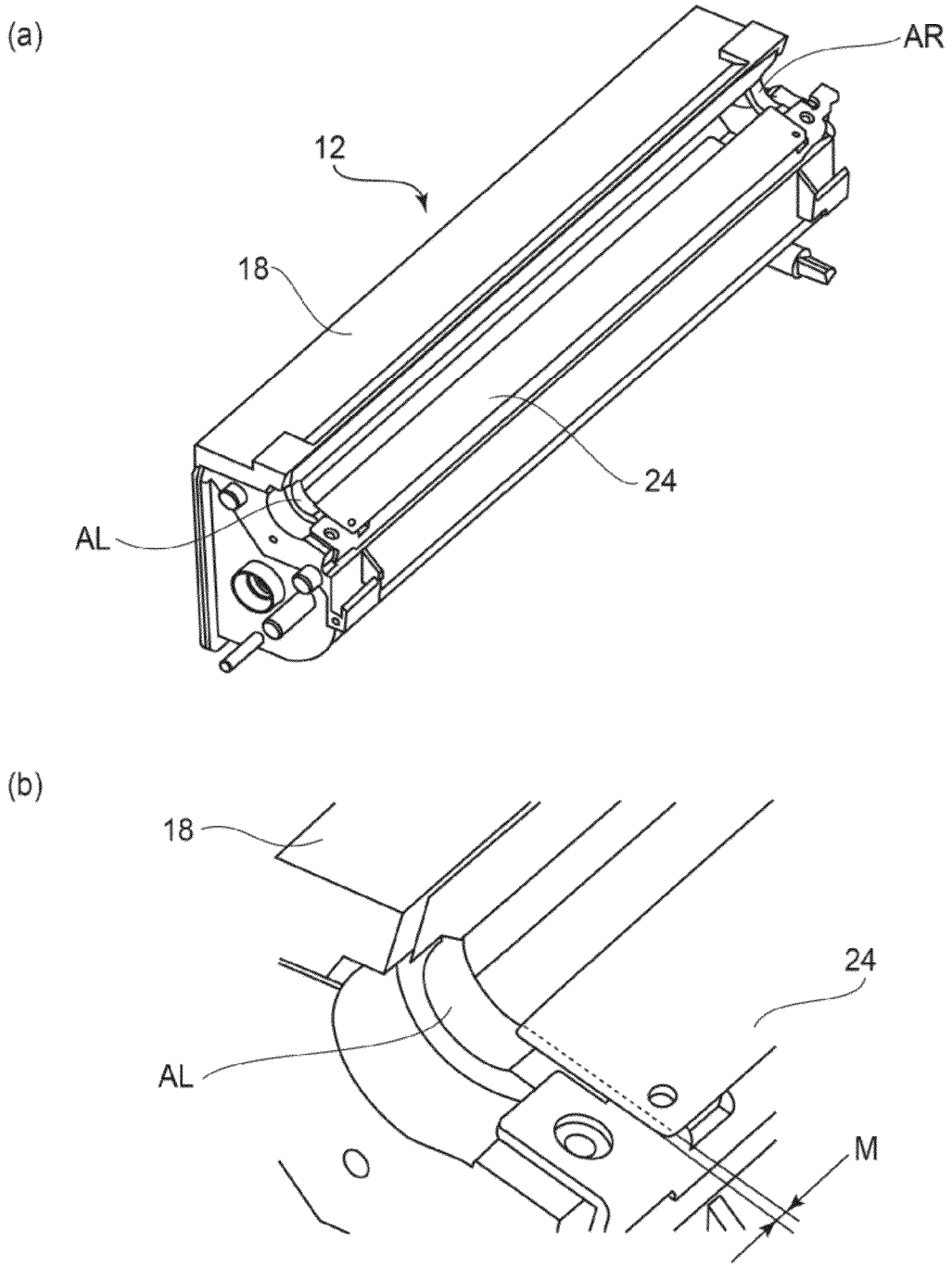

Part (a) of FIG. 16 is a schematic perspective view of the developing unit when a developing roller in the developing unit of the process cartridge according to the present invention is demounted, and (b) of FIG. 16 is a schematic detailed view of (a) of FIG. 16.

Figure 17:
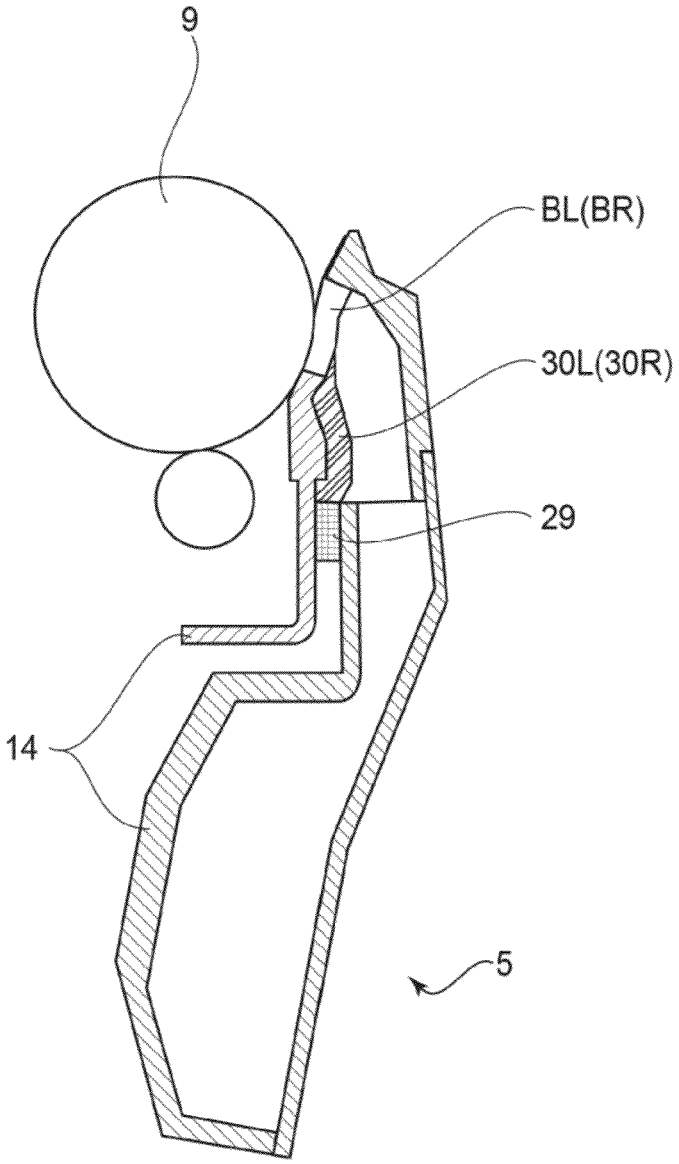

FIG. 17 is a schematic sectional view showing a seal constitution at a cleaning unit end portion of the process cartridge according to the present invention.

Figure 18:
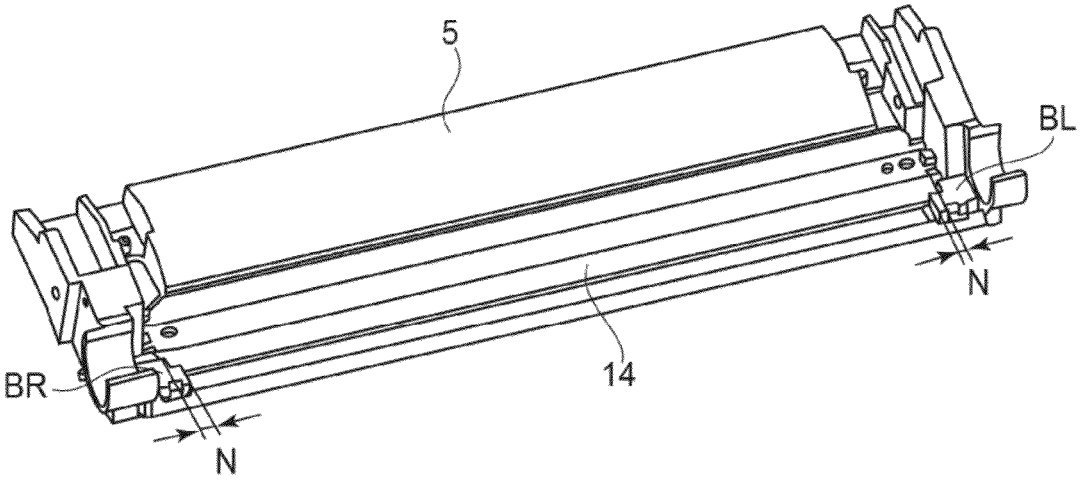
Figure 18:
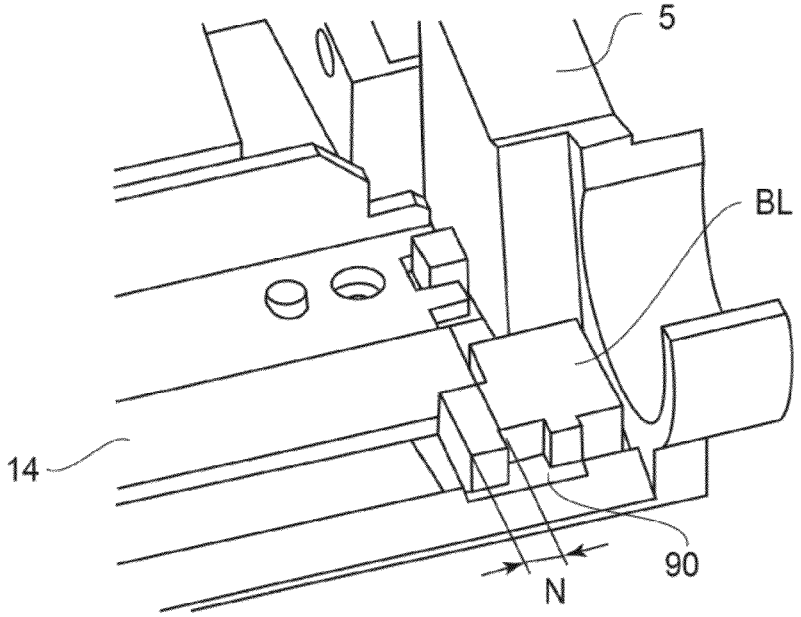

Part (a) of FIG. 18 is a perspective view of an outer appearance of a cleaning unit when a photosensitive drum of the process cartridge according to the present invention is demounted, and (b) of FIG. 18 is a schematic detailed view of (a) of FIG. 18.

Figure 19:
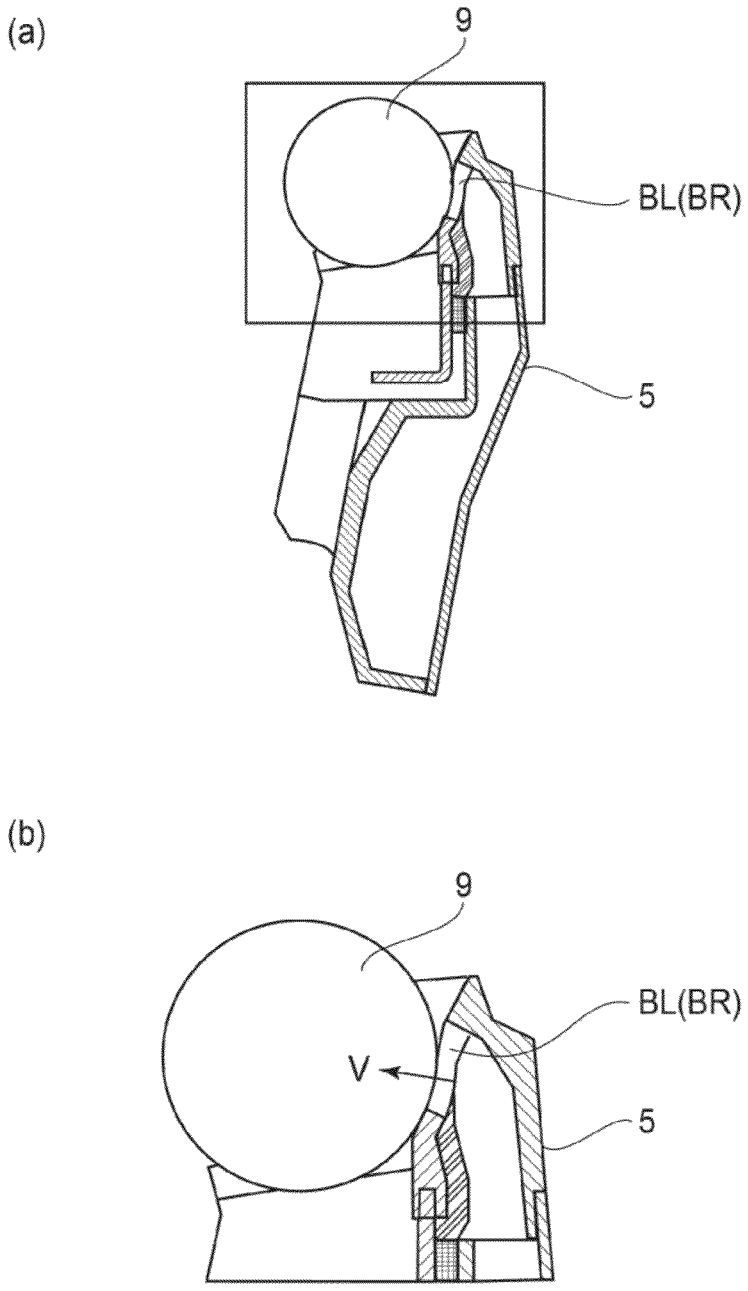

Part (a) of FIG. 19 is a schematic sectional view of a state in which the photosensitive drum is mounted in the cleaning unit for countermeasure to suppress a drum abrasion, and (b) of FIG. 19 is a schematic detailed view of (a) of FIG. 19.

Figure 20:
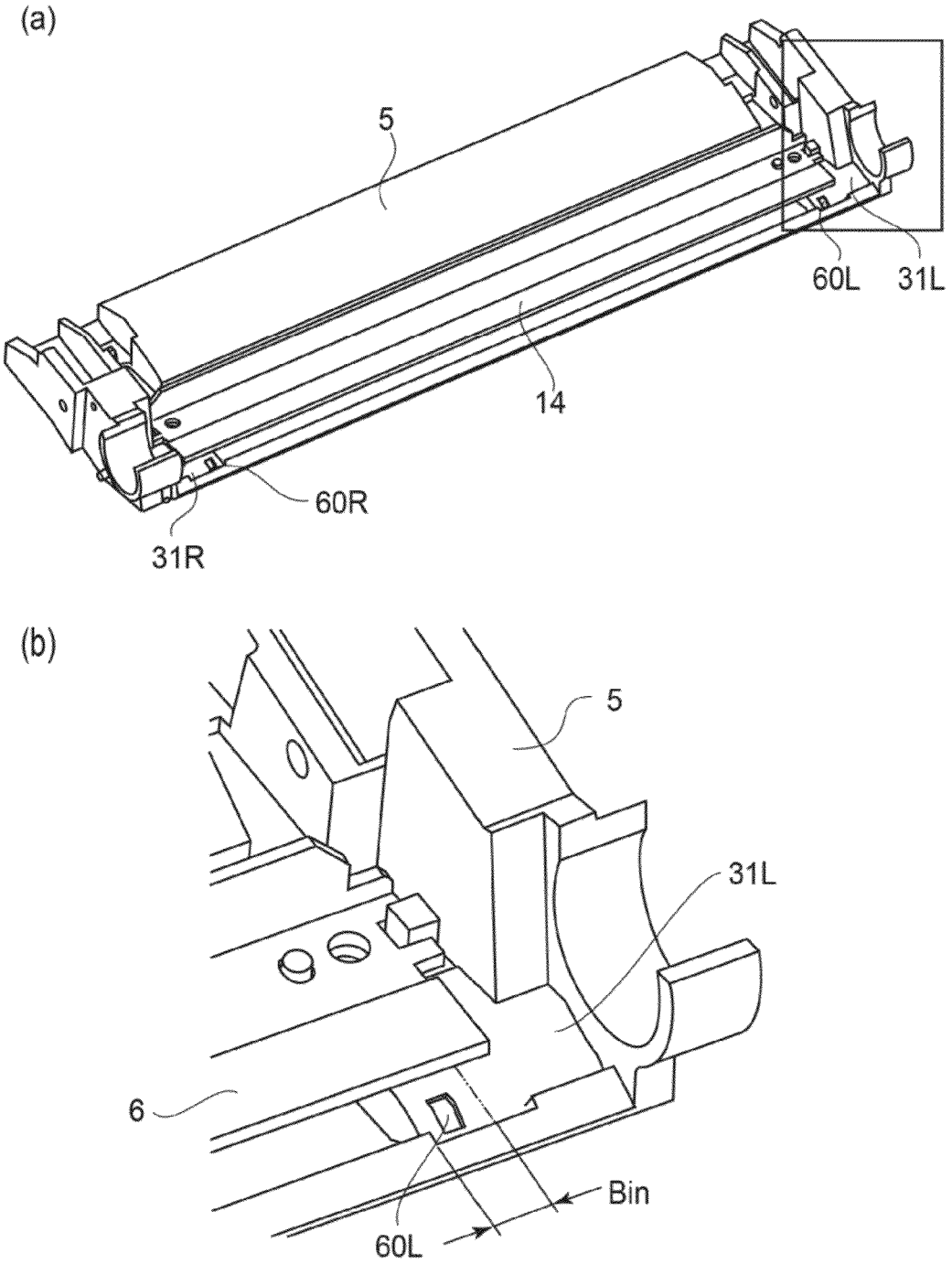

Part (a) of FIG. 20 is a schematic perspective view of a state in which the photosensitive drum and a second seal member in the cleaning unit in the present invention are demounted, and (b) of FIG. 20 is a schematic detailed view of (a) of FIG. 20.

Figure 21:
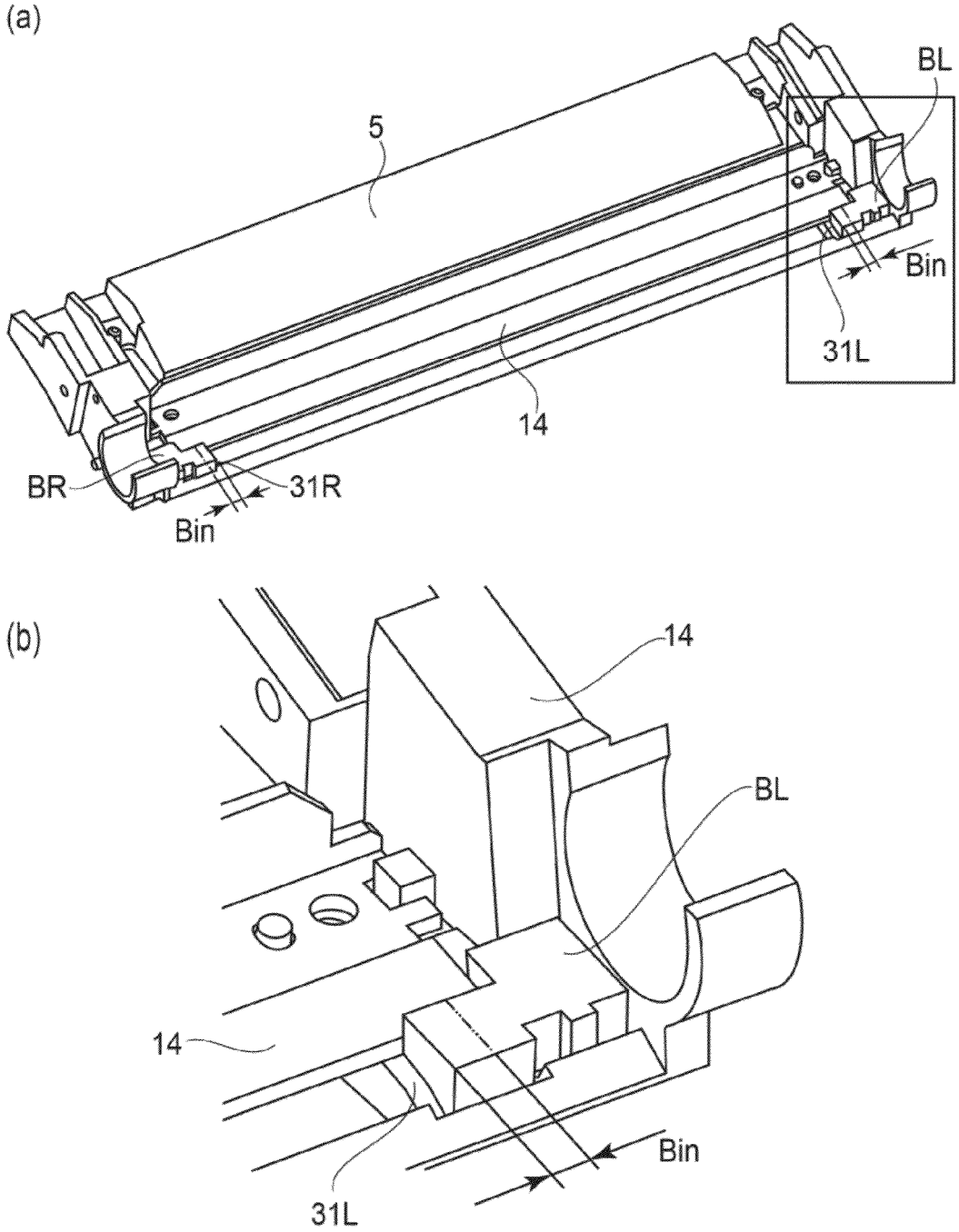

Part (a) of FIG. 21 is a schematic perspective view of a state in which the photosensitive drum is mounted to the cleaning unit for countermeasure to suppress the drum abrasion, and (b) of FIG. 21 is a schematic detailed view of (a) of FIG. 21.

DESCRIPTION OF THE PREFERRED EMBODIMENTS

The present invention will be described on the basis of the drawings. With respect to dimensions, materials, shapes, relative arrangement and the like of constituent elements described in the following embodiments, the scope of the present invention is not limited to only those unless otherwise specified.

[Embodiment 1 ]

(1) General Structure of Electrophotographic Image Forming Apparatus

Figure 1:
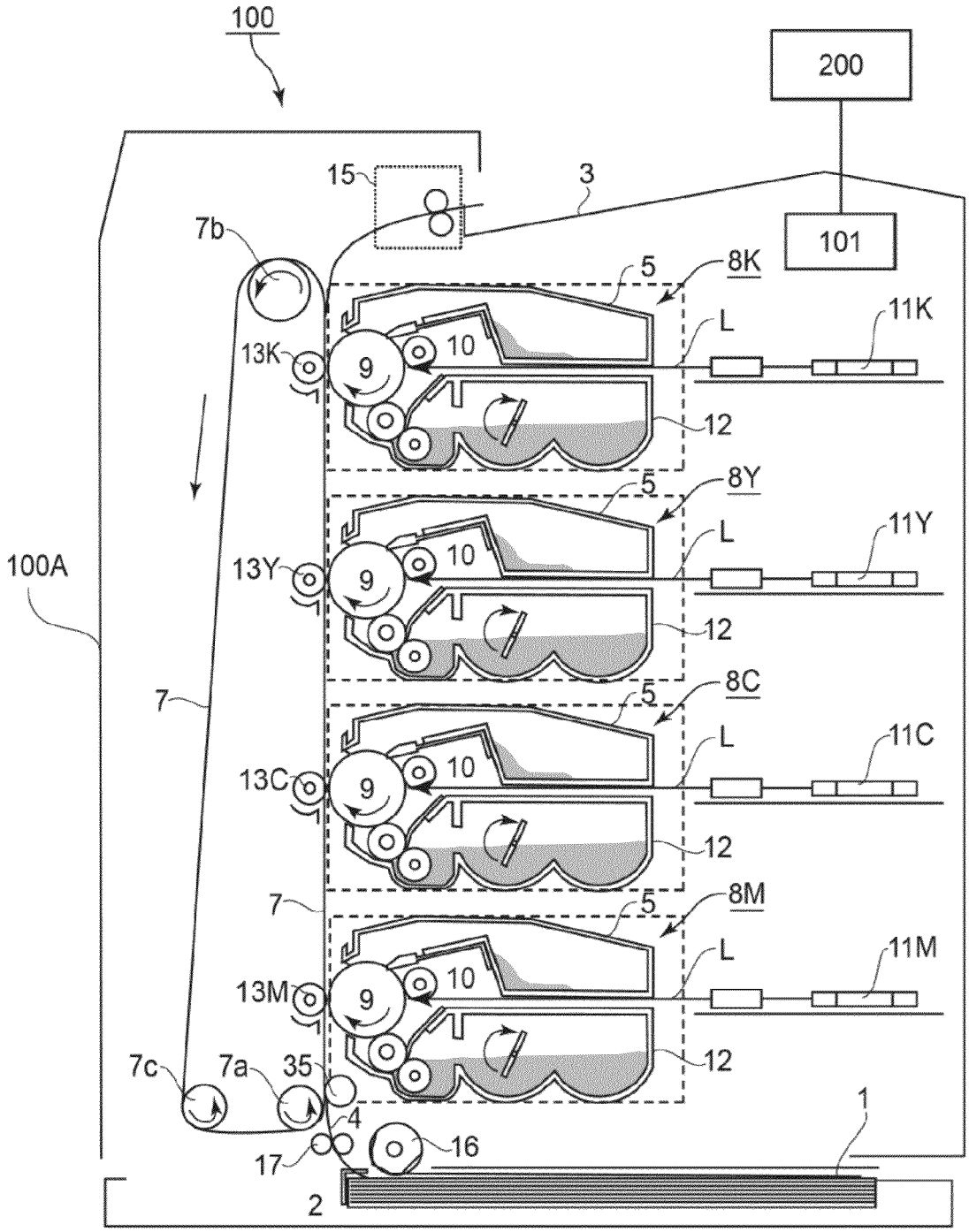
FIG. 1 is a general schematic structural view of an example of an electrophotographic image forming apparatus in Embodiment 1.

FIG. 1 is a schematic structural view of an example of an electrophotographic image forming apparatus 100 according to the present invention. This apparatus 100 is an electrophotographic full-color laser beam printer of a tandem type and is capable of forming a full-color or monochromatic image, on a recording material (medium) 1, corresponding to electrical image information inputted from an external host device 200 such as a microcomputer to a contact circuit portion 101, thus outputting the recording material 1.

The apparatus 100 has a constitution in which four process cartridges 8 (8M, 8C, 8Y, 8K) as first, second, third and fourth image forming means (process stations or image forming stations) are stacked in the order from a lower position to an upper position with respect to the substantially vertical direction (the substantially gravitational direction). Each cartridge 8 includes a rotatable drum type electrophotographic photosensitive member 9, as an image bearing member, on which a latent image is to be formed (hereinafter referred to as a drum 9) and a process means relating to the drum 9, and is detachably mountable to a predetermined inside mounting portion of an image forming apparatus main assembly 100A in a predetermined manner.

The first cartridge 8M accommodates a developer of magenta (M) in a developing device 12 and forms an image of M color. The second cartridge 8C accommodates a developer of cyan (C) in a developing device 12 and forms an image of C color. The third cartridge 8Y accommodates a developer of yellow (Y) in a developing device 12 and forms an image of Y color. The fourth cartridge 8K accommodates a developer of black (K) in a developing device 12 and forms an image of K color.

Figure 2:
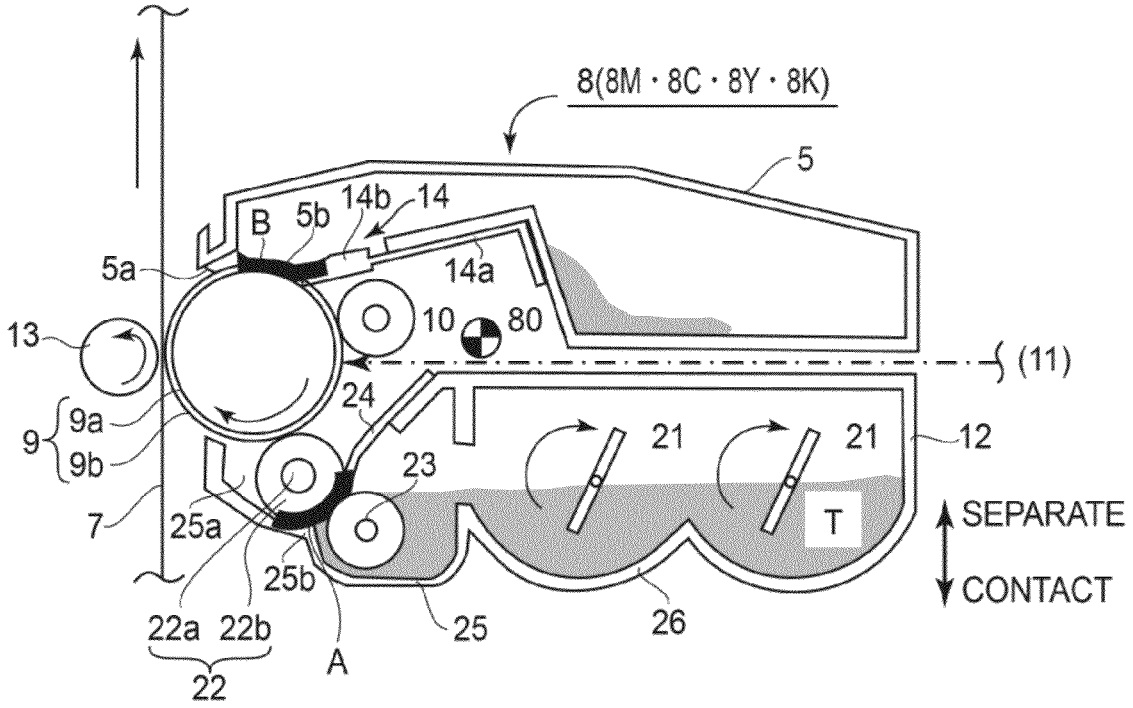
FIG. 2 is an enlarged view of a process cartridge.

The respective drum abrasions 8 mutually have the same structure except that the colors of the developers (toners) accommodated in the developing devices 12 are different from each other. FIG. 2 is an enlarged view of one cartridge 8. The cartridge 8 is constituted by connecting a cleaning device frame 5 and the developing device (developing unit) 12 as a developing means.

The frame 5 holds the drum 9 and, as the process means acting on the drum, a contact charging roller (charging means) 10, a cleaning blade (cleaning means: cleaning member) 14 and the like. The developing device 12 includes a developing device frame 25 and a toner container 26 as a developer accommodating portion. The developing device frame 25 includes a developing roller 22, a toner supplying roller 23, a developing blade 24 and the like. In the toner container 26, a toner T as the developer is accommodated. Further, a toner feeding mechanism 21 is provided.

The above-described cleaning device frame 5 and the developing device 12 are rotatably connected by a pin 80 to provide the cartridge 8. In this embodiment, the above-described charging roller 10, developing device 12 and cleaning blade 14 are the process means relating to the drum 9.

The cleaning device frame 5 of each cartridge 8 is, in a state in which the cartridge 8 is mounted in the apparatus main assembly 100A in a predetermined manner, positioned relative to and held by the apparatus main assembly 100A. The developing device 12 is rotational movement-controlled relative to the cleaning device frame 5 with the pin 80 as the center by a swinging mechanism (not shown) in an apparatus main assembly 100A side. The swinging mechanism is controlled by the control circuit portion 101.

That is, the developing device 12 is swung about the pin 80 by the swing mechanism so that the developing roller 22 is placed in a developable state in which the developing roller 22 is capable of developing the latent image in contact to the drum 9 with a predetermined urging force during execution of development, thus being held in the state. Further, during non-development, the developing device 12 is swung about the pin 80 by the swinging mechanism so that the developing roller 22 is placed in a separation state in which the developing roller 22 is spaced from the drum 9 in a non-contact manner.

A full-color image forming operation is as follows. By an image formation requiring signal from the host device 200, the control circuit portion 101 starts preparatory rotation of laser scanners 11 (11M, 11C, 11Y, 11K) as exposure means for the respective cartridges 8 and preparatory rotation of the drums 9 for the respective cartridges 8 and a transfer conveyance belt 7.

The drum 9 is rotationally driven in the clockwise direction indicated by arrows in FIGS. 1 and 2 at a predetermined peripheral speed. The charging roller 10 is contacted to the drum 9 with a predetermined urging force and is rotated by rotation of the drum 9. The belt 7 is extended and stretched among a plurality of rollers 7*a*, 7*b* and 7*c* and is rotationally driven in the counterclockwise direction indicated by an arrow in FIG. 1 at a speed corresponding to the peripheral speed of the drum 9.

Further, temperature adjusting rotation of a fixing device 15 is started. Further, one sheet of the recording material (transfer material or recording paper) as a recording medium in a sheet feeding portion 2 is separated and taken out by a pick-up roller 16 and is once held by registration rollers 17.

In the first cartridge 8M, when the drum 9 is uniformly charged by the charging roller 10, laser light L depending an image information of M color is emitted from the scanner 11M onto the drum 9, so that an electrostatic latent image is formed. In the developing device 12, the developing roller 22 is driven and at the same time, a developing bias is applied from an unshown source. Simultaneously therewith, the developing device 12 in the separation state is switched to the developable state by the swinging mechanism, so that the developing roller 22 is contacted to the drum 9. As a result, the M color toner is transferred onto the drum 9 correspondingly to the latent image, so that an M color toner image is formed on the drum 9.

On the other hand, the recording material 1 passes through the registration rollers 17 while being timed to the M color toner image on the drum 9 in the first cartridge 8M and is fed onto the belt 7 via a sheet passing path 4, thus being attracted and carried by the belt 7 by the action of an attraction roller 35 as an attracting means. Further, the recording material 1 is conveyed to a transfer portion by the rotational drive of the belt 7, so that the M color toner image is transferred onto the recording material 1 by the action of a transfer device 13M.

Also in the second to fourth cartridges 8C, 8Y and 8K, by the same operation as that in the first cartridge 8M, a C color toner image, a Y color toner image and a K (black) toner image are formed on the drums 9 with predetermined control timing. Then, with conveyance of the recording material 1 to respective transfer portions of the second to fourth cartridges 8C, 8Y and 8K, the above-described respective color toner images are successively transferred superposedly onto the same recording material 1 by the action of the respective transfer devices 13C, 13Y and 13K.

The recording material 1 onto which the toner images of four colors of M, C, Y and K are transferred in the downstreammost fourth cartridge 8K is conveyed to the fixing portion 15, where the toner images are fixed and are conveyed to a discharge portion 3 as a four color-based full-color image-formed product.

In each cartridge 8, the drum 9 after the toner image transfer onto the recording material 1 is subjected to removal of the residual toner by the cleaning blade 14 and is then repetitively subjected to subsequent image formation.

Then, when an image forming job for each of a predetermined one or plural sheets is ended, the control circuit portion 101 stops rotation of an exposure means 11, rotation of the drum 9 and the belt 7, and rotation of the fixing device 15 in each cartridge 8. The developing device 12 is changed to the separation state. In this state, the image forming apparatus is in stand-by for input of a subsequent image formation requiring signal from the host device 200.

(2) Process Cartridge

Figure 3:
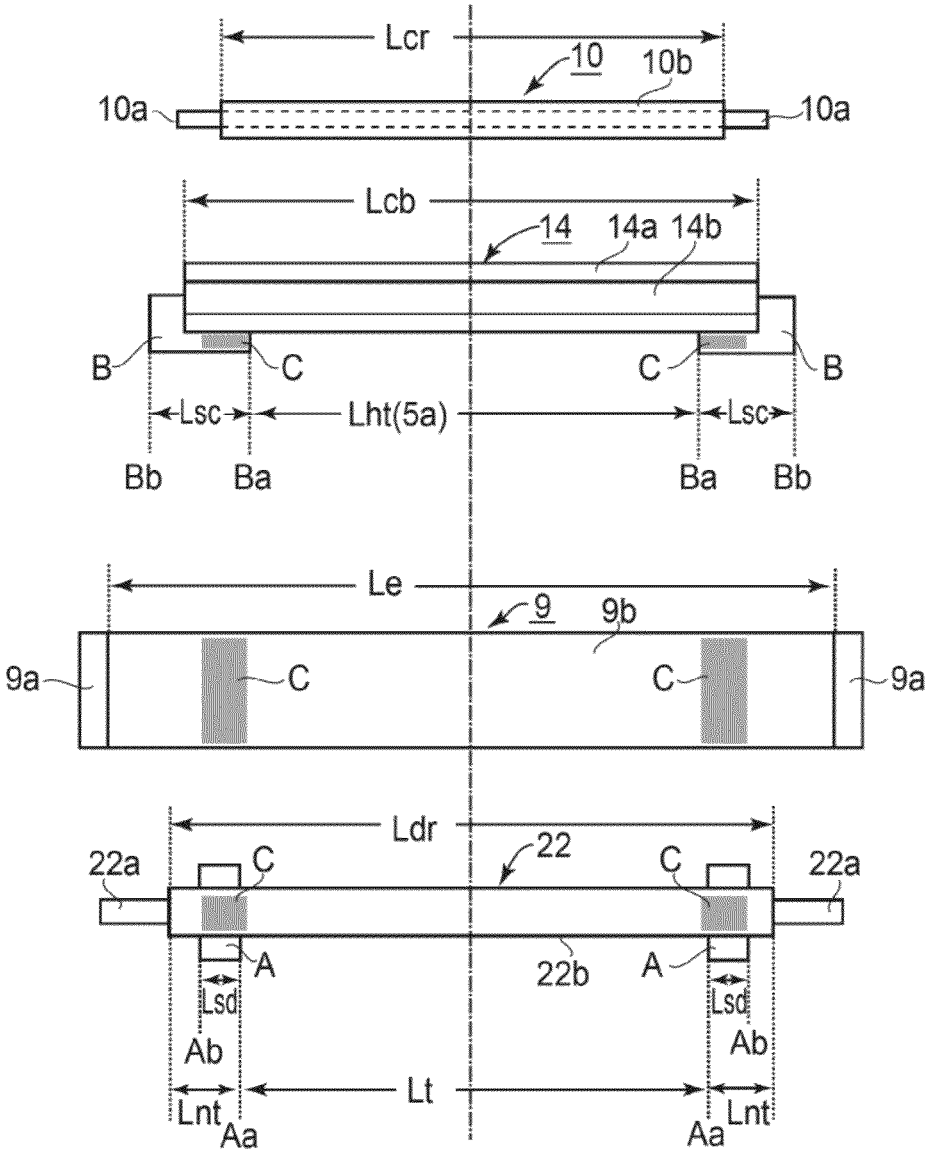
FIG. 3 is an example of a longitudinal length relation in Embodiment 1.

The cartridge 8 will be further described. Here, with respect to the cartridge 8 or members constituting the cartridge 8, a longitudinal direction refers to a rotational axis direction of a rotatable member or a direction parallel to the rotational axis direction. Further, one end side and the other end side of a member refers to those of the member with respect to the longitudinal direction. FIG. 3 shows a dimensional relation of various members constituting the cartridge 8 with respect to the longitudinal direction.

The drum 9 includes a rigid support 9*a*. As the support 9*a*, e.g., an aluminum base tube of 24 mm in diameter and 0.7 mm in thickness is used. Onto an outer peripheral surface of the support 9*a* (onto the support), as a photosensitive layer 9*b*, an organic photoconductive layer is applied. As a material for the photosensitive layer 9*b*, a photosensitive material containing a polyarylate resin is used. In this embodiment, an application region Le of the photosensitive layer 9*b* (longitudinal length of the photosensitive layer 9*b*) may only be required to be equal to or longer than a longitudinal length Ldr of the developing roller 22, and was 250 mm.

The developing device 12 includes the toner container 26 and the developing device frame 25 as described above. The toner accommodated in the toner container 26 is sent to the toner supplying roller 23, rotatably held by the developing device frame 25, by the toner feeding mechanism 21 provided in the toner container 26. Then, the sent toner is supplied to the developing roller 22.

The developing roller 22 is rotationally driven in the counterclockwise direction indicated by an arrow in FIG. 2 at a predetermined speed. The toner supplying roller 23 is rotationally driven in the counterclockwise direction indicated by an arrow in contact to the developing roller 22. Therefore, at a contact portion between the developing roller 22 and the supplying roller 23, surface movement directions of the developing roller 22 and the supplying roller 23 are opposite directions. As a result, the toner is coated from the supplying roller 23 onto the developing roller 22.

Further, on the developing device frame 25, the developing blade 24 as a developer applying member is provided. The developing blade 24 is contacted to the surface of the developing roller 22.

The toner T in this embodiment is almost spherical non-magnetic toner with a negative chargeability as a one-component developer. A center particle size was about 7 μm and as a flowability imparting agent, hydrophobic silica was externally added to the toner in an amount of 1.5 wt. %. By coating the toner surface with the external additive, improvement of the negative chargeability was achieved and by providing a minute gap between toner particles, improvement of the flowability was achieved.

The developing device frame 25 includes an opening 25*a* in a surface side of the drum 9 with respect to the longitudinal direction and also includes a holding portion 25*b*, in each of longitudinal both sides of the opening 25*a*, for holding the inside of each of both end portions of the developing roller 22. The surface of the holding portion 25*b* in the developing roller 22 side is formed in an arcuate shape and on the arcuate surface, the seal member (developer seal member) A such as the fiber planted material which is the felt member or the like, the pile fabric or the Moltopren is provided. A longitudinal length (width) Lsd of the seal member A is 5 mm.

Further, the developing roller 22 is rotatably held by left and right side plates (not shown) of the developing device frame 25 in a state in which its outer peripheral surface is pressed against the seal member A (developing roller peripheral surface seal type). That is, in each of one end portion side and the other end portion side of the developing roller 22, the seal member A, of the peripheral surface seal type, for preventing the developer leakage is provided. Each of the toner supplying roller 23 and the developing roller 22 is provided in parallel to the drum 9.

The developing roller 22 described in this embodiment includes a core metal 22*a* of SUS (stainless steel) and an electroconductive elastic member 22*b* provided on an outer peripheral surface of the core metal 22*a* so as to have a diameter of 16 mm. A volume resistivity under application of a voltage of −50 V was about $10^5$-$10^6\Omega$ from the viewpoints of a developing property and an image quality. Further, a hardness is 50 degrees in terms of Asker C hardness and is 40 degrees in items of MD 1 hardness. Both end portions of the core metal 22*a* are rotatably supported by the developing device frame 25. Further, the developing roller 22 is press-contacted to the drum 9 with a predetermined urging force so that the elastic member 22*b* enters the surface of the drum 9 by 40 μm in a state in which the developing roller 22 is contacted to the drum 9 in the developable state.

The developing roller 22 is rotated with a peripheral speed difference of 140% with respect to the drum 9 during the development and develops with the toner the electrostatic latent image on the drum 9. Further, from the end portion of the core metal 22*a*, a developing bias of 300 V is applied during the development. Further, in order to prevent the toner leakage (developer leakage) from the longitudinal both end portions of the developing device frame 25, the seal member A is contacted to the end portion peripheral surface of the elastic member 22*b* as described above.

In this embodiment, the longitudinal length Ldr of the developing roller 22 is 240 mm. A longitudinal length of a toner coat region (carrying region where the developer is carried: developing region) Lt, where the toner is applied by the developing blade 24, which is a distance between inside ends Aa and Aa of the seal members A and A was 222 mm. Therefore, a non-toner-coat region (non-carrying region where the developer is not carried) Lnt in which the toner is not coated on the developing roller 22 from the inside end As of the seal member A to an outside end of the developing roller 22 is 9 mm.

In this embodiment, the toner coat region (developing region) Lt of the developing roller 22 is 222 mm and therefore an A4-sized recording material 1 can be passed by the short edge feeding (the long edge feeding for an A5-sized recording material 1).

The charging means 10 is of the contact charging type. In this embodiment, the charging means 10 is an electroconductive roller (charging roller) which includes an electroconductive elastic member 10*b* provided on an outer peripheral surface of a core metal 10*a* and which is formed in a roller shape. The roller 10 is contacted to the drum 9, and a predetermined charging bias is applied during charging from an end portion of the core metal 10*a* of the roller 10. As a result, the surface of the drum 9 is uniformly charged. A longitudinal length Lcr of the roller 10 is 228 mm.

The cleaning means 14 includes a metal plate 14*a* of SUS and an elastic blade 14*b* (cleaning blade) as a cleaning member provided by thermocompression-bonding an elastic rubber chip to an end of the metal plate 14*a*. An end of the blade 14*b* is contacted to the surface of the drum 9 with a desired angle and penetration depth (amount). By the blade 14*b*, a remaining deposited matter such as a transfer residual toner is removed from the surface of the drum 9, thus cleaning the surface of the drum 9.

The cleaning means 14, the charging means 10 and the drum 9 are provided in the cleaning device frame 5 which also functions as a residual toner accommodating container. A seal member (cleaning seal member) B formed of, e.g., the fiber-planted material such as a wool felt, the pile fabric which is a velour material, and Moltopren (urethane foam) is provided in L-shape or a reverse L-shape in intimate contact to longitudinal both end portions of the blade 14*b*.

The seal member B also functions as a retaining member provided so as to be capable of retaining the toner removed from the drum 9. A gap between inside ends Ba and Ba of the seal members B and B constitutes an opening 5*a* of the cleaning device frame 5. Further, the seal member B is press-contacted to the drum 9 to obtain a peripheral surface sealing effect. A surface of a holding portion 5*b* for holding the inside of the drum 9 at each of both end portions of the drum 9 is formed in an arcuate shape, and the seal member B is bonded onto the arcuate surface.

That is, the seal member B for preventing the developer leakage is provided in each of one end portion and the other end portion of the blade 14*b* as the cleaning member. The seal member B is constituted in the L-shape or the reverse L-shape, scraped off from the surface of the drum 9 by the blade 14*b*, from laterally moving in the longitudinal direction of the blade to be dropped onto the outside of the cleaning device frame 5.

Generally, a longitudinal length Lsc of the blade 14*b* of the seal member B is determined for the purpose of preventing the above-described drop of the toner. In this embodiment, in the case of only the drop-preventing purpose, the longitudinal lengths of 8 mm at a blade side end portion and of 4 mm immediately under the blade with respect to the longitudinal direction are sufficient for that purpose. However, in this embodiment, as described later, the longitudinal length Lsc is determined for the purpose of achieving also drum abrasion suppression at the same time, so that the longitudinal length Lsc of the blade 14*b* of the seal member B is 17 mm. Particularly, the longitudinal length is 8 mm at the blade end portion and is 9 mm in the region immediately under the blade.

In this embodiment, a longitudinal length Lcb of the blade 14*b* was 237 mm. Lht is a distance between the inside ends Ba and Ba of the seal members B and B, which is the opening 5*a* of the cleaning device frame 5.

As described above, a relation between the longitudinal length Lcb of the blade 14*b* and the longitudinal length Ldr of the developing roller 22 is made to satisfy: Ldr>Lcb and at the same time, the longitudinal length Lcb of the blade 14*b* is made longer than the toner coat region Lt. Generally, the longitudinal length Lcb of the blade 14*b* is made longer than the sum of the developing region Lt and the widths Lsd and Lsd of the peripheral surface seal member A provided at both sides of the developing region Lt so that the toner leaked from the developing device and entering the seal members A and A can be collected.

(3) Relation among Longitudinal Lengths of Process Cartridge

With reference to FIG. 3, a constitution as the longitudinal lengths of the cartridge 8 will be described. FIG. 3 shows longitudinal lengths of the drum 9, the charging roller 10, the developing roller 22, the seal members A and A, the blade 14*b* and the seal members B and B.

The relation between the longitudinal length Lcb of the blade 14*b* and the longitudinal length Ldr of the developing roller 22 is made to satisfy: Ldr > Lcb, so that a photosensitive member surface abrasion in a region where the developing roller 22 and the drum 9 contact outside the cleaning blade 24*b* with respect to the longitudinal direction is suppressed.

The reason for this suppression will be described. By repeating the image forming step, abraded powder of the photosensitive layer is interposed between the drum 9 and the developing roller 22. Further, this region is located outside a contact region of the cleaning blade 14*b* and therefore the abraded powder of the photosensitive layer is continuously present without being removed from the drum 9 by the cleaning blade 14*b*. Therefore, an effect of buffering sliding and abrasion between the developing roller 22 and the drum 9 is continued and thus the photosensitive member surface abrasion can be suppressed.

In this embodiment, the drum abrasion occurred conspicuously inside the cleaning blade 14*b* with respect to the longitudinal direction (in the region of Lcb) and in the developing roller peripheral surface seal region (region of Lsd).

Opposedly to the longitudinal length Lcb of the cleaning blade 14*b*, the developing roller 22 has the toner coat region Lt and the non-toner-coat regions Lnt and Lnt. Further, the drum abrasion has a feature such that a degree thereof becomes larger in the non-toner-coat region Lnt than in the toner coat region Lt. This is because the toner is present as an intervening matter between the developing roller 22 and the drum 9 in the toner coat region Lt to buffer the sliding and on the other hand, the toner is not present in the non-toner-coat region Lnt.

Particularly, in the developing roller peripheral surface seal region Lsd of the non-toner-coat region Lnt, the seal member A removes the intervening matter on the developing roller 22. For this reason, the intervening matter is not present between the photosensitive drum surface and the developing roller surface, so that the photosensitive drum surface and the developing roller surface are directly contacted and mutually slide and abrade, so that the degree of the drum abrasion becomes large.

Therefore, a relation between Lht which is the distance between the inside ends Ba and Ba of the seal members B and B and Lt which is the distance between the inside ends Aa and Aa of the seal members A and A is made to satisfy: Lt≥Lht. As a result, the toner coat region Lt and the seal member B are close to each other. The toner coat region Lt is a region where the transfer residual toner is generated after the transfer step, and the toner which laterally moves when the transfer residual toner is collected as a residual toner (waste toner) is liable to enter the seal member B. A position where the toner enters is determined with respect to the width Lsd of the seal member A, with the result that the seal member B is set so as to overlap with the seal member A. This is a feature of this embodiment.

By optimizing the full width Lsc of the seal member B, it is possible to prevent the residual toner from laterally moving in the longitudinal direction of the blade 14*b* to be dropped onto the outside of the cleaning device frame 5.

In this embodiment, the seal members A and A and the seal members B and B are symmetrically disposed, respectively, with respect to the same center line (the same line). Therefore, a distance from the center line to the inside end Aa of the seal member A is ½×Lt, and a distance from the center line to the inside end Ba of the seal member B is ½×Lht.

The relation between Lht which is the distance between the inside ends Ba and Ba of the seal members B and B and Lt which is the distance between the inside ends Aa and Aa of the seal members A and A is made to satisfy: Lt≥Lht, and the full width Lsd of the seal member A and the full width Lsc of the seal member B are made to satisfy:

$$(\tfrac{1}{2}\times Lt+Lsd)\leq(\tfrac{1}{2}\times Lht+Lsc).$$

That is, a position of the inside end Ba of the seal member B is located at the same position as or inside the position of the inside end Aa of the seal member A. Further, a position of an outside end Bb of the seal member B is located at the same position as or outside a position of an outside end Ab of the seal member A. By disposing the seal members A and B in this way, the seal member B overlaps with the seal member A.

The residual toner entering the gap between the drum 9 and the seal member B press-contacted to the surface of the drum 9 has a residual accumulating effect to some extent, as a residual toner buffer, immediately under the blade 14*b*. In general, the residual toner scraped off from the surface of the drum 9 is constituted so as to be successively accommodated in the residual toner accommodating container and therefore is not present in the neighborhood of the blade 14*b*. On the other hand, when the residual toner was always present in the neighborhood of the blade 14*b*, it was found that a slip-through opportunity arose such that the residual toner slipped through the blade 14*b* frequently although some amount of the residual toner is present.

That is, the residual toner is properly accumulated (in addition to the residual toner, abraded powder P of the photosensitive layer 9*b*, the toner, the external additive and the like are also accumulated) particularly in the region, of the non-toner-coat region Lnt, where the seal member width Lsc longitudinally overlaps with the seal member width Lsd, thus being caused to slip through the blade 14*b*. That is, when the width of the seal member A is Lsd and the width of the seal member B is Lsc, in an overlapping region of Lsd and Lsc at the longitudinal position, the seal member B press-contacts the drum 9 and accumulates the developer at the press-contact portion.

That is, in the region of the longitudinal position where the seal member A and the seal member B overlap with each other, the seal member B press-contacts the drum 9. As a result, the residual toner is continuously supplied in some amount, as an intervening matter C, to the surface of the developing roller 22 or the surface of the drum 9, so that the abrasion of the photosensitive layer 9*b* is suppressed (reduced).

(4) Study of Drum Abrasion and Solution

When the surface abrasion of the drum 9 occurs considerably, the bias applied to the developing roller 22 flows into the abraded portion of the drum 9, so that an image defect which is called a leak image is generated. In order to remedy the image defect (leak image) generated due to the drum abrasion in the image forming apparatus, study on I) Drum abrasion in toner coat region Lt and non-toner-coat region Lnt and II) Solution was made.

I) Drum Abrasion in Toner Coat Region Lt and Non-Toner-Coat Region Lnt

As Comparative Embodiment 1, an image forming test was conducted by using a full-color laser beam printer ("Color Laser Jet CP 3525dn") at the following settings. As a test condition, the image formation of 24000 sheets in a 2-sheet intermittent manner was effected with a print ratio of 1% in an environment of 23° C./50% RH. In the printer, the above-described relation between the longitudinal length Lcb of the blade 14*b* and the longitudinal length Ldr of the developing roller 22 was set at Ldr>Lcb, and the relation between the toner coat region Lt and the non-toner-coat region Lht was set at Lht>Lt.

Figure 4:
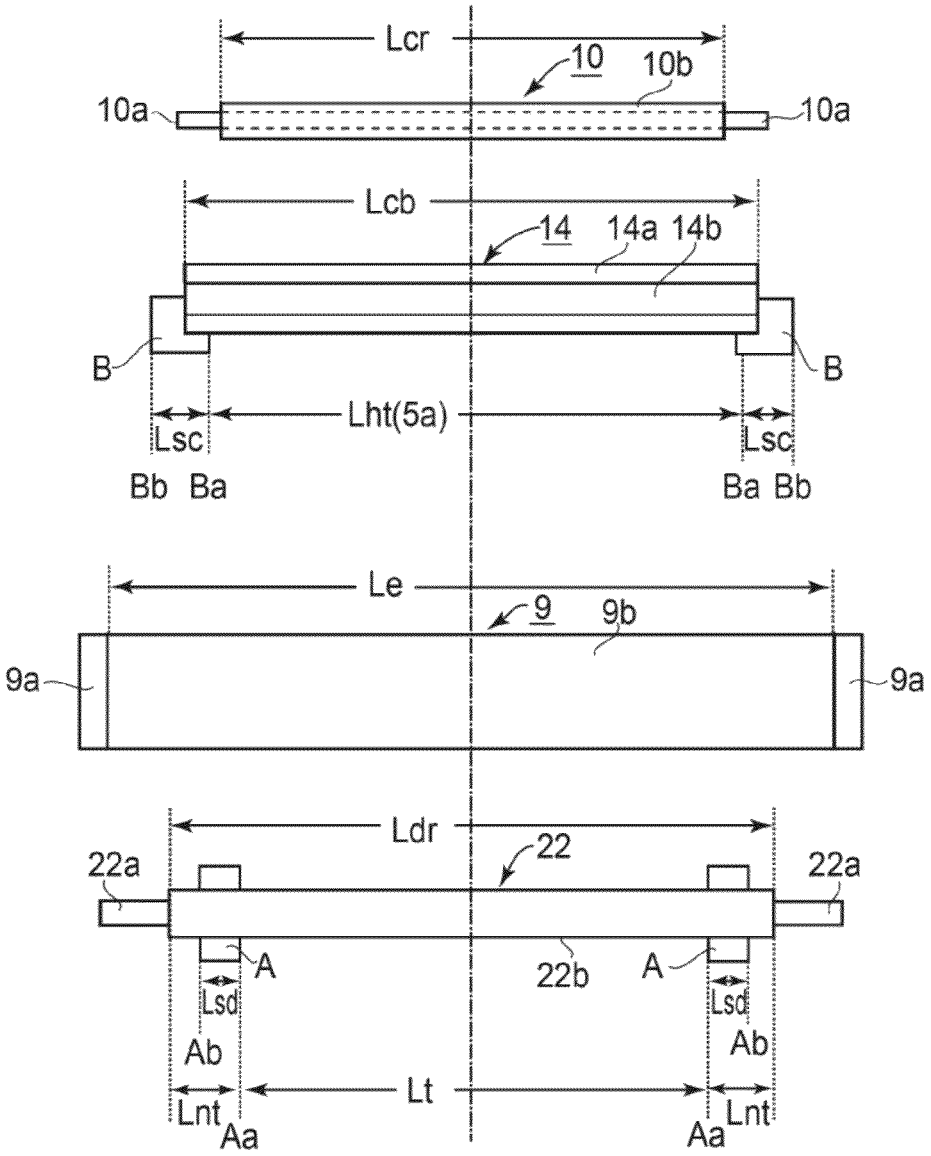
FIG. 4 is an example of a longitudinal length relation in Comparative Embodiment 1.
Figure 5:
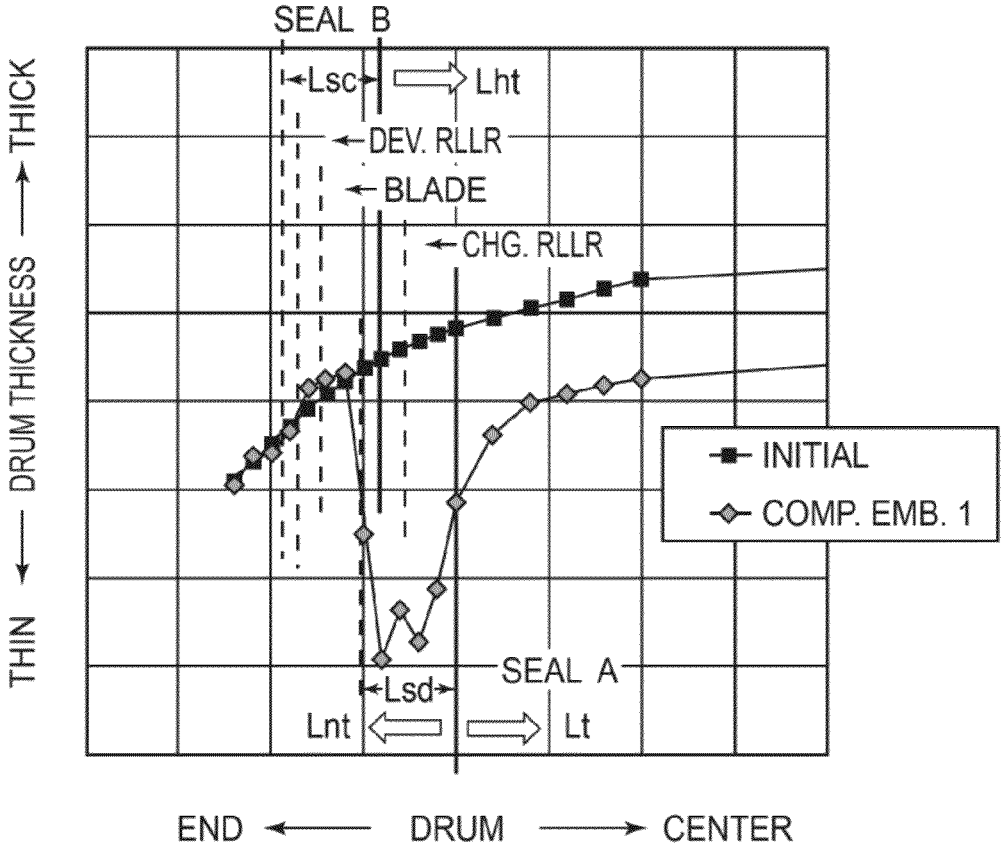
FIG. 5 is a graph showing a drum abrasion amount in Comparative Embodiment 1.

In Comparative Embodiment 1, the longitudinal length relation is shown in FIG. 4 and the drum abrasion at that time is shown in FIG. 5. As shown in FIG. 5, the drum abrasion has a feature such that its degree becomes larger in the developing roller peripheral surface seal region Lsd of the non-toner-coat region Lnt than in the toner coat region Lt. In the printer in Comparative Embodiment 1, in the toner coat region Lt, the toner is present, as the intervening matter C, between the surface of the drum 9 and the surface of the developing roller 22. For this reason, a region where the surface of the drum 9 and the surface of the developing roller 22 directly contact and mutually slide and abrade is decreased, so that the degree of the drum abrasion becomes small.

On the other hand, particularly in the developing roller peripheral surface seal region Lsd of the non-toner-coat region Lht, the seal member A further removes the intervening matter and therefore the intervening matter is not present between the photosensitive drum surface and the developing roller surface. For this reason, the photosensitive drum surface and the developing roller surface directly contact and mutually slide and abrade, so that the degree of the drum abrasion becomes large.

II) Solution

In the case where the above-described relation between the toner coat region Lt and the non-toner-coat region Lht is Lt≥Lht, the residual toner accumulated by the seal member B provided at the end portion of the blade 14*b* slides through the blade 14*b* and is supplied in some amount to the developing roller peripheral surface seal region Lsd. The supplied residual toner is caused to act as the intervening matter C between the developing roller 22 and the drum 9, so that the drum abrasion can be remarkably suppressed.

Figure 6:
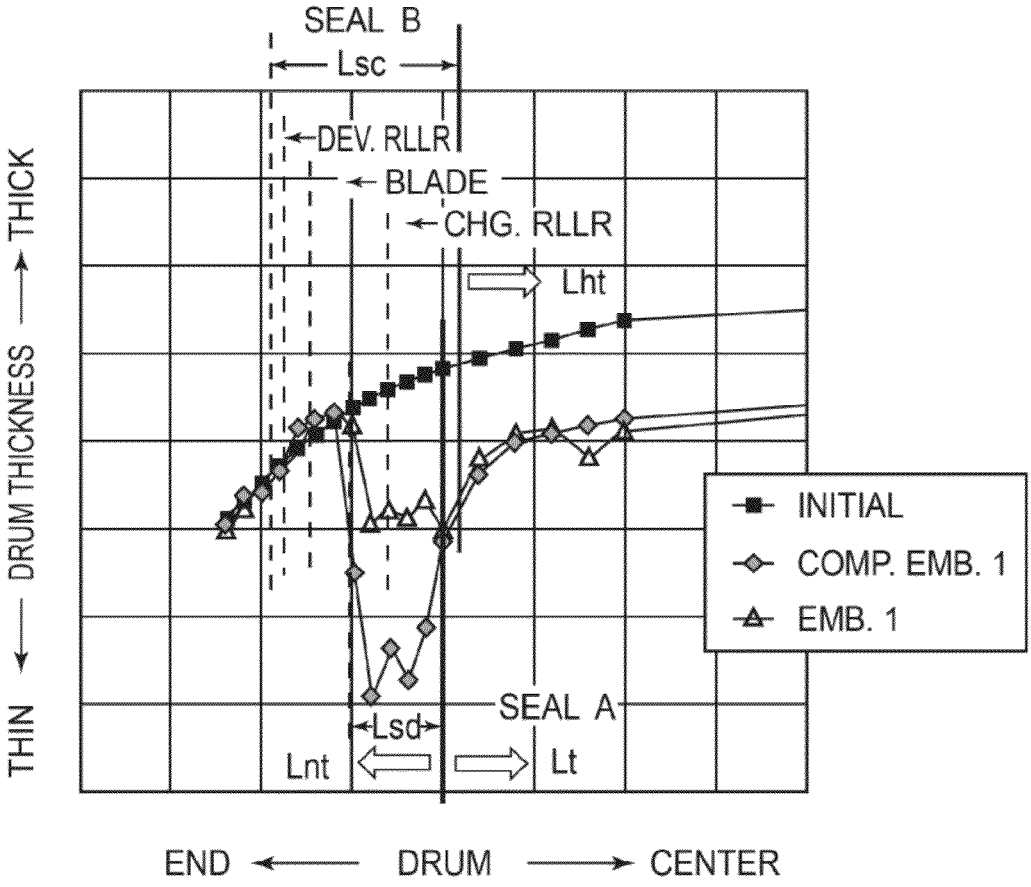
FIG. 6 is a graph showing a drum abrasion amount in Embodiment 1.

In actuality, an experiment for comparing a drum abrasion amount in the case of Lht>Lt with a drum abrasion amount in the case of Lt>Lht was conducted. As an experimental condition, the image formation of 24000 sheets was effected in the 2 sheet intermittent manner with the print ratio of 1% in the environment of 23° C./50% RH . FIG. 6 is a graph showing a result of the experiment. In FIG. 6, the experimental result in the case of Lht<Lt shown in FIG. 5 is also shown.

As is apparent from FIG. 6, by satisfying Lt≥Lht, the drum abrasion in the non-toner-coat region Lnt was considerably suppressed. According to this embodiment, as described above, Lt≥Lht is satisfied, so that in the non-toner-coat region Lnt, the degree of the drum abrasion of the drum 9 can be reduced and it is possible to suppress an occurrence of the leak image.

In the image forming apparatus in this embodiment, the photosensitive member surface is deteriorated by electric discharge by the charging roller, and the above-described abrasion of the photosensitive member by the sliding and friction of the developing roller constitutes a main factor more than the abrasion of the photosensitive member generated by scraping off the photosensitive member surface by the contact of the cleaning member.

In the process cartridge described with reference to FIG. 2, an experiment for comparing the drum abrasion amount between a separation state between the developing roller 22 and the photosensitive drum 9 and a contact state between the developing roller 22 and the photosensitive drum 9 was conducted.

As an experimental condition, the image formation of 24000 sheets was effected in the 2-sheet intermittent manner with the print ratio of 1% in the environment of 23° C./50% RH.

Figure 7:
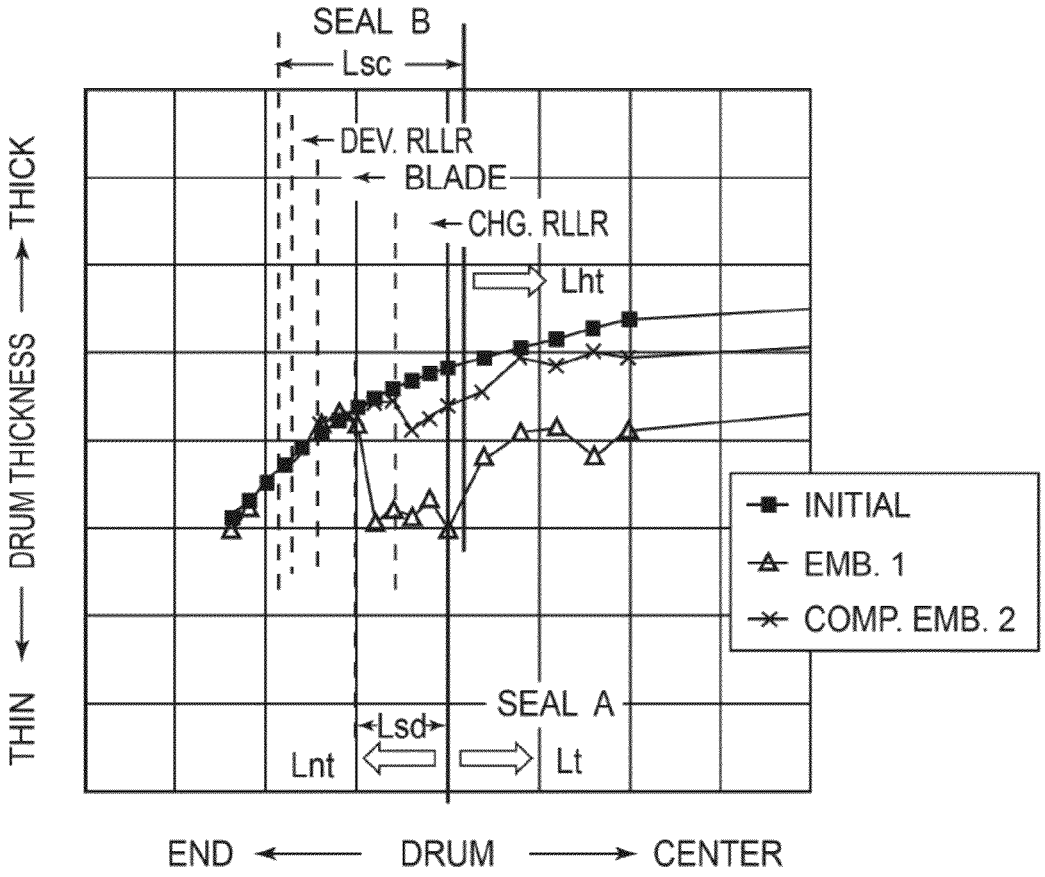
FIG. 7 is a graph showing a drum abrasion amount in Comparative Embodiment 2.

In Comparative Embodiment 2, the experiment is conducted in a spaced state between the developing roller 22 and the photosensitive drum 9 and therefore the toner image is not formed even when the image is formed. The print ratio of 1% in Comparative Embodiment 2 means formation of the latent image capable of printing of 1% and in this state, the toner image is not formed. In order to create the spaced state, the control circuit portion for controlling the swing mechanism was devised so as to always retain the separated state. As an experimental result in the contact state, that in Embodiment 1 shown in FIG. 6 is cited. FIG. 7 is a graph showing the experimental result.

The drum abrasion in the region located outside of the end portion of the charging roller and in the developing roller peripheral surface seal roller Lsd in Comparative Embodiment is generated only in the contact state (Embodiment 1). As a reason for this, rotational drive of the developing roller with a predetermined pressure and peripheral speed difference with respect to the photosensitive drum can be cited.

In this embodiment, the relation between the toner coat region Lt and the non-toner-coat region Lht is Lt≥Lt. By satisfying such a relation, the residual toner accumulated in the developing roller peripheral surface seal region Lsd by the seal member B at the end portion of the blade 14*b* can be passed through the blade 14*b* to be supplied in some amount. The residual toner is caused to act as the intervening matter C between the developing roller 22 and the drum 9, so that the drum abrasion can be remarkably suppressed.

[Embodiment 2]

In this embodiment, in order to further downsize the process cartridge, the relation between the longitudinal length Lcb of the blade 14*b* and the longitudinal length Ldr of the developing roller 22 is made to satisfy Ldr≤Lcb.

Figure 8:
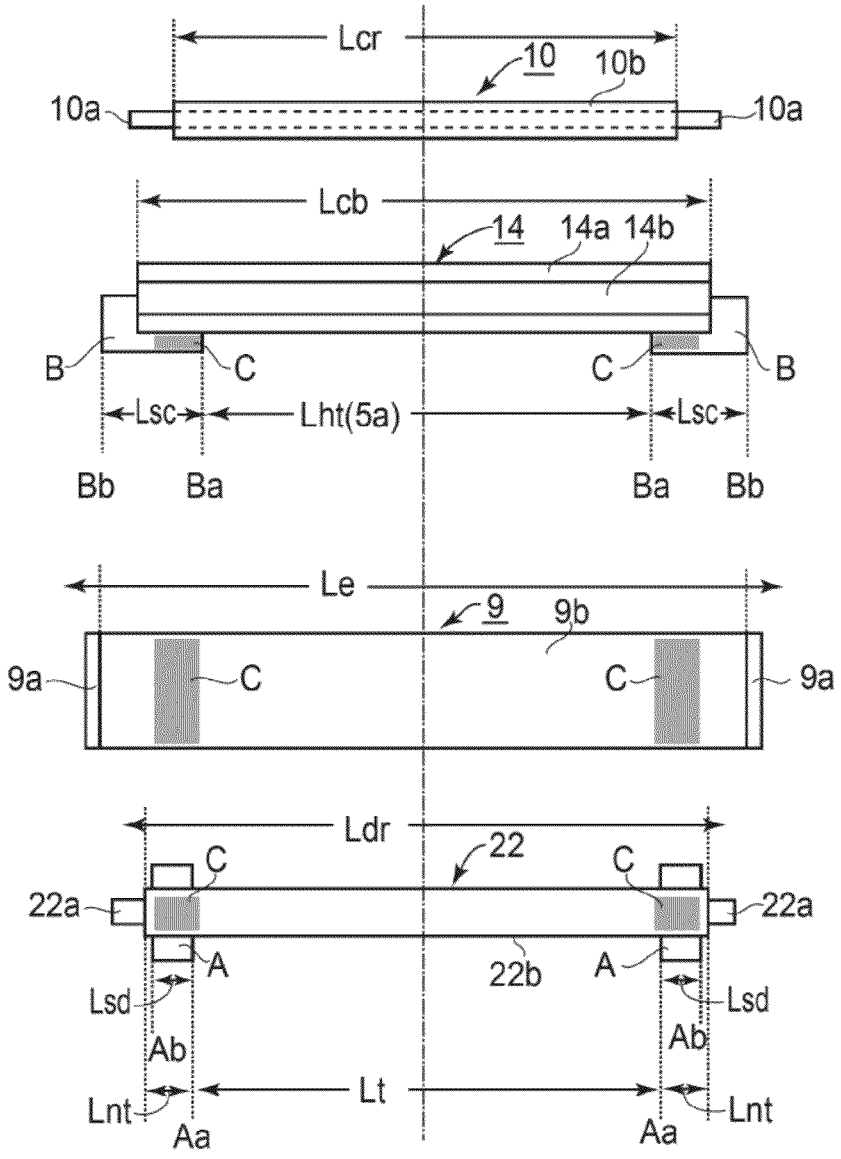
FIG. 8 is an example of a longitudinal length relation in Embodiment 2.

With reference to FIG. 8, description will be made specifically. The application region Le of the photosensitive layer 9*e* (the longitudinal length of the photosensitive layer) was 245 mm. The longitudinal length Ldr of the developing roller 22 was 236 mm. The longitudinal length (width) Lsd of the seal member A is 5 mm. The longitudinal length of a Lt, which is a distance between inside ends Aa and Aa of the seal members A and A, was 222 mm. Therefore, a non-toner-coat region Lnt in which the toner is not coated on the developing roller 22 from the inside end As of the seal member A to an outside end of the developing roller 22 is 7 mm. The longitudinal length Lcb of the cleaning blade 14*b* was 237 mm.

The longitudinal length Lsc of the blade 14*b* of the seal member B is 17 mm. Particularly, the longitudinal length Lsc is 8 mm at the end portion and is 9 mm immediately under the seal member B. Therefore, Lht as a distance, between the inside ends Ba and Ba of the seal members B and B, which is the opening 5*a* of the cleaning device frame 5 is 220 mm. Other constitutions are the same as those in Embodiment 1.

As described in Embodiment 1, the drum abrasion occurs longitudinally inside the cleaning blade 14*b*, i.e., in the region of Lcb. In this embodiment, the relation between the longitudinal length Lcb of the blade 14*b* and the longitudinal length Ldr of the developing roller 22 is made to satisfy Ldr≤Lcb, so that downsizing is achieved. At this time, in the region of Lcb where the drum abrasion occurs, the longitudinal relation in Embodiment 1 and in Embodiment 2 is the same. That is, the position of the inside end Ba of the seal member B is located at the same position as or inside the position of the inside end Aa of the seal member A.

Further, the outside end Bb of the seal member B is located at the same position as or outside the position of the outside end Aa of the seal member A. Also in this embodiment, by satisfying Lt≥Lht, the drum abrasion in the non-toner-coat region Lnt can be remarkably suppressed.

In order to verify an effect in this embodiment, an experiment for comparing a drum abrasion amount in the case of Lht>Lt (Comparative Embodiment 3) with a drum abrasion amount in the case of Lt≥Lht (Embodiment 2) was conducted. The relation between the longitudinal length Lcb of the blade 14*b* and the longitudinal length Ldr of the developing roller 22 is Ldr≤Lcb in both of Comparative Embodiment 3 and Embodiment 2. As an experimental condition, the image formation of 24000 sheets was effected in the 2-sheet intermittent manner with the print ratio of 1% in the environment of 23° C./50% RH.

Figure 9:
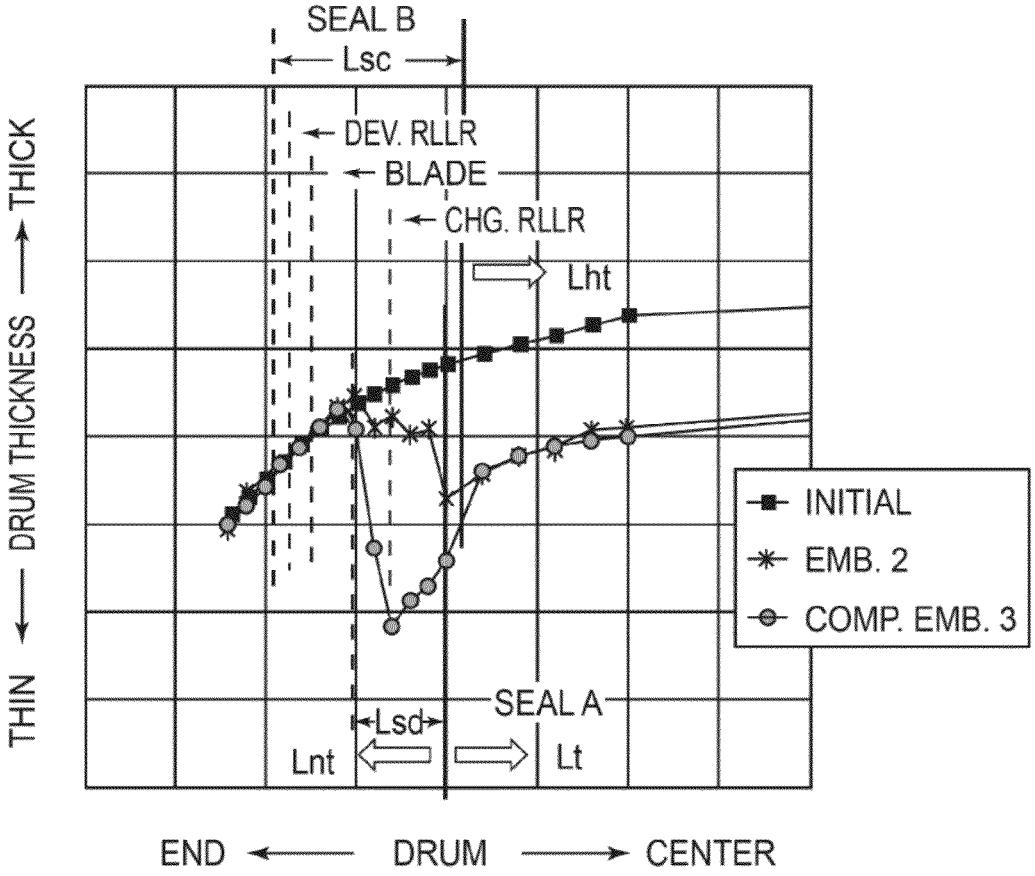
FIG. 9 is a graph showing a drum abrasion amount in Embodiment 2.

FIG. 9 is a graph showing a result of the experiment. As is apparent from FIG. 9, by satisfying Lt≥Lht, the drum abrasion in the developing roller peripheral surface seal region Lsd was considerably suppressed. According to this embodiment, as described above, Lt≥Lht is satisfied, so that in the developing roller peripheral surface seal region Lsd, the degree of the drum abrasion of the drum 9 can be reduced and it is possible to suppress an occurrence of the leak image.

[Embodiment 3]

Another embodiment of the cartridge will be described with reference to FIG. 10. In this embodiment, members and portions common to this embodiment and Embodiment 1 are represented by the same reference numerals or symbols and will be omitted from redundant description. A lowest part of FIG. 10 is a schematic view showing a relation between the drum 9 and the seal member B as seen from a D direction.

The cleaning means 14, the charging means 10 and the drum 9 are provided in the cleaning device frame 5 which also functions as a residual toner accommodating container. The seal member B is provided in L-shape or a reverse L-shape in intimate contact to longitudinal both end portions of the blade 14*b*. A gap between inside ends Ba and Ba of the seal members B and B constitutes an opening 5*a* of the cleaning device frame 5. Further, the seal member B is press-contacted to the drum 9 to obtain a peripheral surface sealing effect. As a part of the cleaning device frame 5, a holding portion 5*b* for holding the inside of the drum 9 at each of both end portions of the drum 9 is formed. The surface of the holding portion 5*b* is formed in an arcuate shape, and the seal member B is mounted on the arcuate surface.

Figure 10:
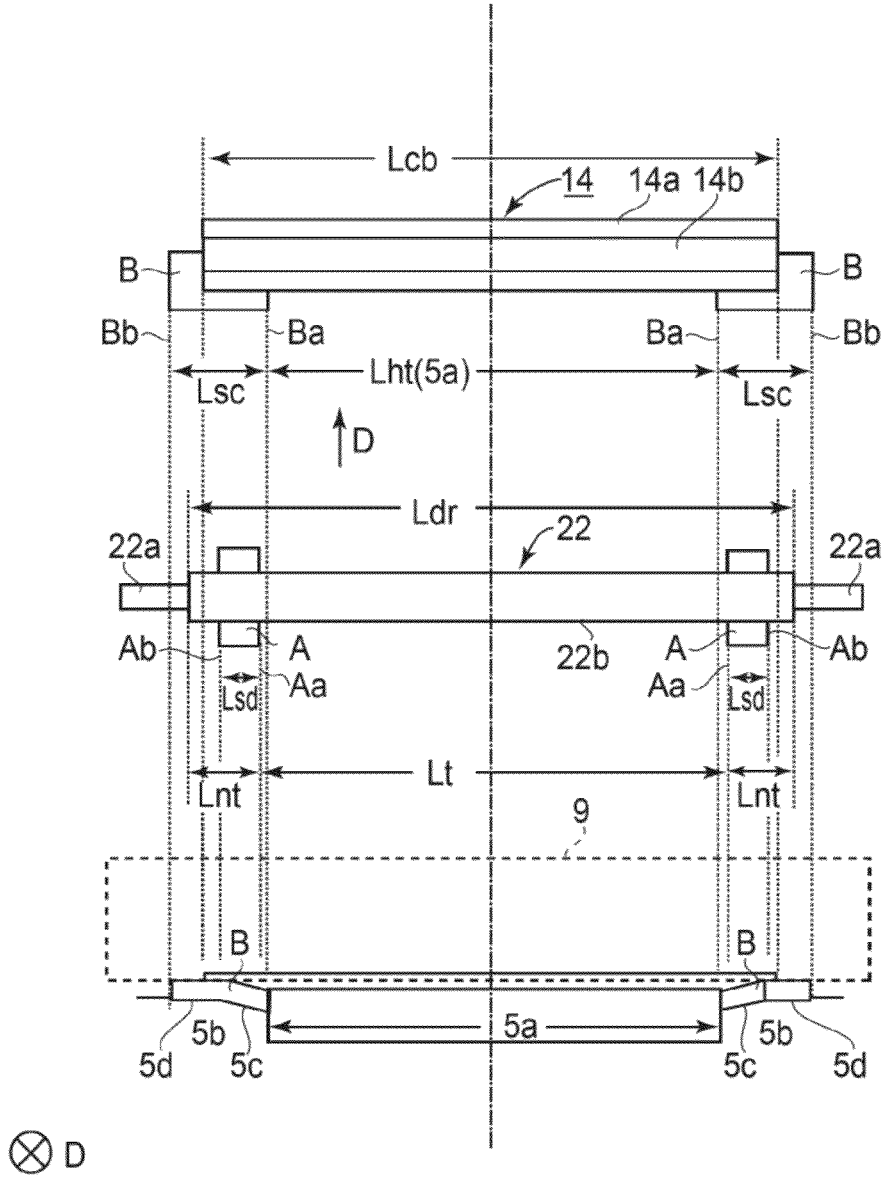
FIG. 10 is an example of a longitudinal length relation in Embodiment 3.

This embodiment is characterized in that the holding portion 5*b* is, as shown in FIG. 10, provided with an inclined portion 5*b* with respect to the longitudinal direction. By this inclined portion 5*c*, the laterally moved toner is caused to easily enter the seal member B. That is, the holding portion 5*b* on which the seal member B is to be mounted is provided with the inclined portion 5*c* such that the inclined portion approaches the drum 9 toward its longitudinal end portion.

By doing so, the seal member B provided on the holding portion 5*b* approaches the drum 9 toward its longitudinal end portion, so that the press-contact force between the seal member B and the drum 9 becomes strong toward the longitudinal end portion. For that reason, it is possible to control easiness of entering of the laterally moved toner.

Further, immediately under the blade 14*b*, as a residual toner buffer, an effect of accumulating the residual toner to some extent is enhanced. That is, the residual toner is always present in the neighborhood of the blade 14*b*, so that an effect of increasing a slip-through opportunity for the surface toner to frequently slip through the blade 14*b* although its amount is small is enhanced.

As shown in FIG. 10, the relation between Lht which is the distance between the inside ends Ba and Ba of the seal members B and B and the toner coat region Lt is made to satisfy: Lt≥Lht.

Also in this embodiment, similarly as in Embodiment 1, a position of the inside end Ba of the seal member B is located at the same position as or inside the position of the inside end Aa of the seal member A.

The holding portion 5*b* is provided with the inclined portion 5*c* with respect to the longitudinal direction at the longitudinal position corresponding to the width Lsd of the seal member A. In a region 5*d*, located outside the inclined portion 5*c*, in which inclination of the inclined portion 5*c* is ended and the holding portion 5*b* is disposed in parallel to the drum 9, the holding portion 5*b* is pressed toward the drum 9 via the seal member B with a predetermined pressure so that the residual toner is laterally moved in the longitudinal direction and is dropped onto the outside of the cleaning device frame 5.

In this embodiment, the longitudinal length Lsc of the blade 14*b* of the seal member B is 17 mm. Particularly, the longitudinal length Lsc is 8 mm at the blade end portion and is 9 mm in a region located immediately under the seal member B. Of these, the region including the inclined portion 5*c* is 5 mm.

In this constitution, the residual toner is easily controlled, more than Embodiment 1, so as to be always present in a predetermined amount in the neighborhood of the blade 14*b*. Further, by satisfying Lt≥Lht, the drum abrasion in the non-toner-coat region Lnt was considerably suppressed. According to this embodiment, as described above, Lt≥Lht is satisfied, so that in the non-toner-coat region Lnt, the degree of the drum abrasion of the drum 9 can be reduced and it is possible to suppress an occurrence of the leak image.

[Embodiment 4]

Another embodiment of the cartridge will be described with reference to FIG. 11. In this embodiment, members and portions common to this embodiment and Embodiment 1 are represented by the same reference numerals or symbols and will be omitted from redundant description.

This embodiment is characterized in that in a constitution in which the relation between the toner coat region Lt and the non-toner-coat region Lht is Lht>Lt, a toner buffer member (retaining member) 27 which is close to the seal member B with respect to the longitudinal direction of the blade 14*b* and has a width Ltb is provided. That is, the seal member for preventing leakage of the toner and the toner buffer member 27 for retaining the toner are separately provided.

Specifically, the toner buffer members 27 and 27 are provided in one end portion side and the other end portion side, respectively, of the blade 14*b*. The toner buffer member 27 is a member, having a function capable of temporarily storing or retaining the toner, such as the felt material or Moltopren (urethane foam). In a longitudinal position region where the seal member A and the toner buffer member 27 overlap with each other, the toner buffer member 27 is constituted to press-contact the photosensitive drum 9.

Figure 11:
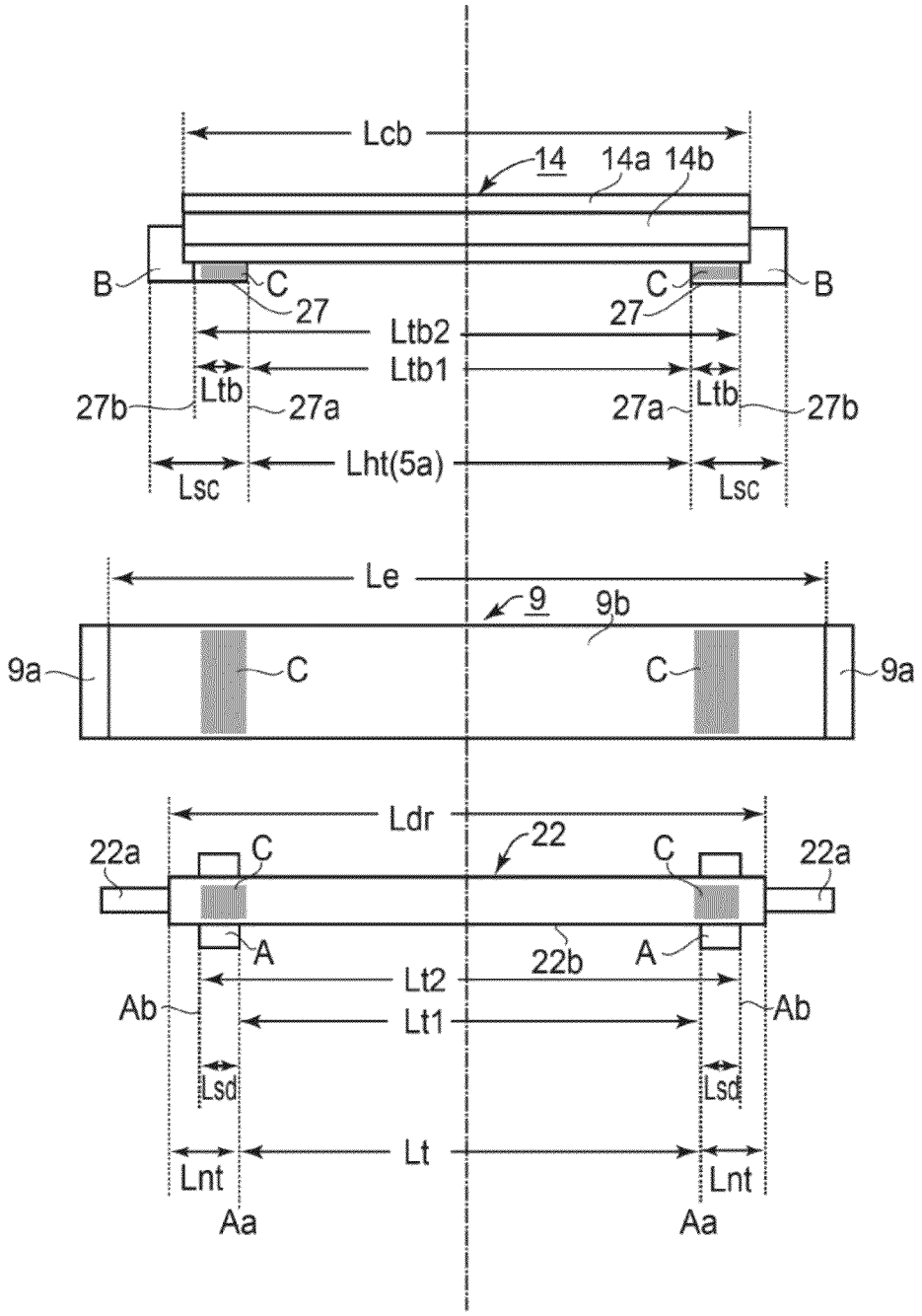
FIG. 11 is an example of a longitudinal length relation in Embodiment 4.

In this case, as shown in FIG. 11, a distance between inside ends 27*a* and 27*a* of the toner buffer members 27 and 27 corresponds to Lht and therefore a relation (of Lht) with the toner coat region Lt is Lt≥Lht.

The seal member B and the toner buffer member 27 are separate members and therefore there is no problem with respect to the function of the seal member B such that the residual toner is laterally moved in the longitudinal direction of the blade 14*b* and thus is dropped into a region located outside the seal member B.

At least, a region of other width Ltb of the toner buffer member 27 may only be required to overlap with a region of the width Lsd of the seal member A. Specifically, a distance between the inside ends Aa and Aa of the seal members A and A is Lt1, and a distance between the outside ends Ab and Ab of the seal members A and A is Lt2.

Further, a distance between the inside ends 27*a* and 27*a* of the toner buffer members 27 and 27 is Ltb1, and a distance between outside ends 27*b* and 27*b* of the toner buffer members 27 and 27 is Ltb2.

In this case, Lt1 and Ltb1 provide a relation of Lt1>Ltb1, and Lt2 and Ltb2 provide a relation of Lt2>Ltb2. In this embodiment, the width Ltb of the toner buffer member 27 was 5 mm. In this embodiment, a position of the inside end 27*a* of the toner buffer member 27 is located at the same position as or inside the position of the inside end Aa of the seal member A. Further, a position of the outside end 27*b* of the toner buffer member 27 is located at the same position as or outside the position of the outside end Ab of the seal member A. By doing so, the toner buffer member 27 overlaps with the seal member A.

As a result, immediately under the blade 14*b*, in the toner buffer member, the residual toner is accumulated to some extent. The residual toner is always present in the neighborhood of the blade 14*b*, so that an effect of increasing a slip-through opportunity for the surface toner to frequently slip through the blade 14*b* although its amount is small is enhanced.

That is, the residual toner accumulated in the toner buffer member 27 slips through the blade 14*b* and is supplied in some amount. The residual toner is caused to act as the intervening matter C, so that the drum abrasion can be remarkably suppressed.

Incidentally, in this embodiment, the toner buffer member 27 is constituted to overlap with the seal member A but the present invention is not limited thereto. A constitution in which the toner buffer member 27 and the seal member B are provided adjacent to each other is employed, and a position of the inside end 27*a* of the toner buffer member 27 is located at the same position as or inside the position of the inside end Aa of the seal member A. Further, a position of an outside end Bb of the seal member B may be located at the same position as or outside a position of an outside end Ab of the seal member A.

[Embodiment 5]

Another embodiment will be described. This embodiment is characterized in that a bonding (applying) surface of the seal member B is provided with a recessed portion. Incidentally, the arrangement relation between the seal member B and the seal member A is the same as that in Embodiment 1. That is, the position of the inside end Ba of the seal member B is located at the same position as or inside the position of the inside end Aa of the seal member A. Further, the position of the outside end Bb of the seal member B is located at the same position as or outside the position of the outside end Ab of the seal member A.

Also in Embodiment 5, by satisfying Lt≥Lht, the drum abrasion in the non-toner-coat region Lht is suppressed. Other portions common to this embodiment and Embodiment 1 will be omitted from description.

(General Structure of Image Forming Apparatus)

A general structure of an image forming apparatus according to this embodiment will be described.

FIG. 13 is a schematic sectional view of an image forming apparatus 100 in this embodiment.

The image forming apparatus 100 includes a plurality of image forming stations, first, second, third, and fourth image forming portions SY, SM, SC and SK for forming yellow (Y), magenta (M), cyan (C), and black (K) images, respectively. In this embodiment, the first to fourth image forming portions SY, SM, SC and SK are arranged side by side in a straight row intersectional to the vertical direction.

Incidentally, in this embodiment, the first to fourth image forming portions are substantially the same in structure and operation except that they are different in the color of the image to be formed. Therefore, unless they need to be differentiated, they will be described collectively by omitting suffixes Y, M, C and K.

That is, in this embodiment, the electrophotographic image forming apparatus 100 includes, as a plurality of image bearing members, four photosensitive drums 9 which are juxtaposed in a direction intersectional to the vertical direction. The photosensitive drum 9 rotates in a direction indicated by an arrow G in the figure. Around the photosensitive drum 9, a charging roller 10 and a scanner unit (exposure device) 11 are provided.

Here, the charging roller 10 is a charging means for uniformly charging the surface of the photosensitive drum 9. Further, the scanner unit (exposure device) 11 is an exposure means for forming an electrostatic image (electrostatic latent image) on the surface of the photosensitive drum 9 by irradiating the photosensitive drum 9 with a laser beam based on image information. Further, around the photosensitive drum 9, a developing unit 12 and a cleaning member 14 are provided.

Here, the developing unit 12 is a developing means for developing the electrostatic image as a toner image. Further, the cleaning member 14 is a cleaning means for removing a toner (transfer residual toner) remaining on the surface of the photosensitive drum 9 after (toner image) transfer. Further, an intermediary transfer belt 28 as an intermediary transfer member for transferring toner images from the photosensitive drums 9 onto a recording material 1 is disposed oppositely to the four photosensitive drums 9.

Incidentally, in this embodiment, the developing unit 12 uses, as the developer, a non-magnetic one-component developer, i.e., the toner. Further, in this embodiment, the development unit 12 effects contact reverse development by bringing a developing roller 22 as a developer carrying member into contact to the photosensitive drum 9.

In this embodiment, the photosensitive drum 9, and processing means acting on the photosensitive drum 9 including the charging roller 10, the developing unit 12, and the cleaning member 14, are integrally supported in the form of a cartridge to prepare a process cartridge 8. The process cartridge 8 is detachably mountable to the main assembly of the image forming apparatus 100 through unshown mounting means, such as a mounting guide and a positioning member, provided in the image forming apparatus 100. In this embodiment, all the process cartridges 8 for the respective colors have the same shape. In the process cartridges 8, toners of colors of yellow (Y), magenta (M), cyan (C), and black (K), respectively, are accommodated.

The intermediary transfer belt 28 is in contact with all the four photosensitive drums 9, and rotates in a direction indicated by an arrow H in the figure. The intermediary transfer belt 28 is stretched around a plurality of supporting members (a driving roller 51, a secondary transfer opposite roller 52, and a follower roller 53).

On an inner peripheral surface side of the intermediary transfer belt 28, four primary transfer rollers 13, as primary transferring means, are arranged in parallel so that they oppose the four photosensitive drums 9, respectively.

Further, on an outer peripheral surface side of the intermediary transfer belt 28, a secondary transfer roller 32 as a secondary transfer means is disposed at a position in which the intermediary transfer belt 28 opposes a secondary transfer opposite roller 52 as a secondary transfer means.

During image formation, first, the (peripheral) surface of the photosensitive drum 9 is electrically charged uniformly by the charging roller 10. Next, the charged surface of the photosensitive drum 9 is subjected to scanning exposure by a beam of laser light emitted from the scanner unit 11 correspondingly to image information to form an electrostatic image, which is in accordance with the image information, on the photosensitive drum 9. Then, the electrostatic image formed on the photosensitive drum 9 is developed by the developing unit 12 as a toner image. The toner image formed on the photosensitive drum 9 is transferred (primary-transferred) onto the intermediary transfer belt 28 by the action of the transfer roller 13.

For example, during full-color image formation, the above described processes are sequentially carried out at the first to fourth image forming stations SY, SM, SC, and SK, so that respective color toner images are sequentially transferred (primary-transferred) superposedly onto the intermediary transfer belt 28.

Thereafter, the recording material 1 is conveyed to the secondary transfer portion in synchronism with the movement of the intermediary transfer belt 28. Then, the four color toner images on the intermediary transfer belt 28 are transferred together (secondary-transferred) onto the recording material 1 by the action of the secondary transfer roller 32, which is kept pressed against the intermediary transfer belt 28 through the recording material 1.

The recording material 1, onto which the toner images are transferred is conveyed to a fixing device 15 as a fixing means. In the fixing device 15, the toner images are fixed on the recording material 1 by application of heat and pressure to the recording material 1.

Primary transfer residual toner remaining on the photosensitive drum 9 after the primary transfer step is removed by the cleaning member 14 to be collected into a removed-toner chamber 14*c*. Further, secondary transfer residual toner remaining on the intermediary transfer belt 28 after the secondary transfer step is removed by an intermediary transfer belt cleaning device 38.

Incidentally, the image forming apparatus 100 is constituted so that it can also form a monochromatic or multicolor image, with the use of only desired one, or some, (not all of them) of the image forming portions.

(Process Cartridge)

Next, the general structure of the process cartridge 8 to be mounted in the image forming apparatus 100 in this embodiment will be described. FIG. 14 is a schematic principal sectional view of the process cartridge 7 placed in a state in which the photosensitive drum 9 and the developing roller 22 contact each other.

The process cartridge 8 includes a cleaning device frame 5 provided with the photosensitive drum 9 and the like and includes the developing unit 12 provided with the developing roller 22 and the like. The cleaning device frame 5 supports various elements provided therein. To the cleaning device frame 5, the photosensitive drum 9 is mounted, via an unshown bearing, rotatably in the arrow G direction indicated in the figure. The photosensitive drum 9 of the cleaning device frame 5 is irradiated with laser light L emitted from the scanner unit provided in the image forming apparatus main assembly.

Further, in the cleaning device frame 5, so as to contact the peripheral surface of the photosensitive drum 9, the charging roller 10 and the cleaning member 14 are disposed. The transfer residual toner removed from the surface of the photosensitive drum 9 by the cleaning member 14 falls into the removed-toner chamber 14*c*. Further, to the cleaning device frame 5, a charging roller bearing 33 is mounted along a line which passes through the rotation center of the charging roller 10 and the rotation center of the photosensitive drum 9.

Here, the charging roller bearing 33 is mounted movably in a direction of an arrow I indicated in the figure. A rotation shaft 10*a* of the charging roller 10 is rotatably mounted on the charging roller bearing 33. Further, the charging roller bearing 33 is urged toward the photosensitive drum 9 by a charging roller urging spring 34 as an urging means.

On the other hand, the developing unit 12 includes a developing device frame 18 for supporting various elements provided in the developing device frame 18. In the developing unit 12, the developing roller 22 as a developer carrying member rotated in a direction (the counterclockwise direction) of an arrow D indicated in the figure in contact to the photosensitive drum 9 is provided. The developing roller 22 is rotatably supported by the developing device frame 18 via a developing roller bearing (not shown) at each of both end portions thereof with respect to its longitudinal direction. Here, the developing roller bearing is mounted to each of both end portions of the developing device frame 18.

Further, the developing unit 12 includes a developer accommodating chamber (toner accommodating chamber) 18*a* and a developing chamber 18*b* in which the developing roller 22 is provided. A partition wall for separating the toner accommodating chamber 18*a* and the developing chamber 18*b* is provided with an opening 18*c*. When the process cartridge 8 is shipped, on a surface of the partition wall in the developing chamber 18*b* side, a developer seal member 36 for preventing scattering of the toner in the toner accommodating chamber 18*a* toward the outside of the process cartridge 8 is provided so as to cover the opening 18*c*.

The developer seal member 36 is, after the process cartridge 8 is mounted in the image forming apparatus 100, pulled in the longitudinal direction via a driving train (not shown) of the process cartridge 8. Thus, the toner accommodating chamber 18*a* is unsealed through the opening 18*c*.

In the developing chamber 18*b*, a toner supplying roller 23 as a developer supplying member rotating in contact to the developing roller 22 in a direction of an arrow E and a developing blade 24 as a developer regulating member for regulating a toner layer on the developing roller 22 are disposed. Further, in the toner accommodating chamber 18*a* of the developing device frame 18, stirring member 24 for stirring the accommodated toner and feeding the toner to the toner supplying roller 23 is provided.

The developing unit 12 is rotatably connected to the cleaning device unit 5 about engaging shafts 25 (25R and 25L) engaged in holes 19Ra and 19La provided to bearings 19R and 19L. Further, the developing unit 12 is urged by an urging spring 37. For that reason, during the image formation of the process cartridge 8, the developing unit 12 is rotated about the engaging shafts 25 in an arrow F direction, so that the photosensitive drum 9 and the developing roller 25 contact each other.

(Seal Members for Developing Unit and Cleaning Unit)

Next, with reference to FIGS. 15 to 18, a seal constitution of each of the developing unit 12 and the cleaning device frame 5 at longitudinal end portions will be described. FIG. 15 and (a) and (b) of FIG. 16 are a schematic sectional view and schematic perspective views, respectively, of the developing unit 12 at an end portion, and FIG. 17 and (a) and (b) of FIG. 18 are a schematic sectional view and schematic perspective views, respectively, of the cleaning device frame 5 at an end portion. Incidentally, each of seal members provided in the developing unit 12 and the cleaning device frame 5 has the same constitution at each of associated both ends and therefore only a constitution in one end side is shown and described.

As shown in FIG. 15, at each of the longitudinal end portions of the developing unit 12, a first seal member (developer seal member) A for sealing a gap defined by the developing device frame 18, the developing roller 22 and the developing blade 24 is provided. Each seal member A is formed of a flexible material such as the fiber-planted material (e.g., the wool felt), the urethane foam or a rubber. Each of the seal members A (AR, AL) is bonded to the developing device frame 18 by a double-side tape and is disposed so as to cover a part of an outer peripheral surface of the developing roller 22. Further, a gap between the seal member A and the developing device frame 18 is sealed by pouring a member such as a hot-melt adhesive 90 into the gap.

Part (a) of FIG. 16 is a perspective view of an outer appearance of the developing unit 12 when the developing roller 22 is demounted, and (b) of FIG. 16 is an enlarged view of an end portion of the developing unit 12. The developing blade 24 and the seal member A overlap with each other in a region of a width M with respect to the longitudinal direction of the developing blade 24. As a result, when the developing roller 22 is mounted, the seal member A is compressed in a certain amount by the developing blade 24, so that a sealing property between the developing blade 24 and the seal member A is ensured.

On the other hand, as shown in FIG. 7, at each of the longitudinal end portions of the cleaning device frame 5, similarly as in the case of the first seal member, a second seal member (cleaning seal member) B (BR, BL) for sealing a gap defined by the cleaning device frame 5, the photosensitive drum 9 and the cleaning member 14 is provided. Each seal member B is formed of a flexible material such as the fiber-planted material (e.g., the wool felt), the urethane foam or a rubber. The seal member B is bonded to the cleaning device frame 5 by a double-side tape and is disposed so as to cover a part of an outer peripheral surface of the photosensitive drum 9.

Further, over the longitudinal direction of the cleaning device frame 5, a gap sealing member 29, formed of a member such as a hot-melt adhesive, for sealing a gap between the cleaning member 14 and the cleaning device frame 5 is provided. Further, at each of longitudinal both end portions of the cleaning device frame 5, an auxiliary sealing member 30, as an integral member of, e.g., the urethane foam and the double-side tape, for sealing a gap between the cleaning member 14 and the gap sealing member 29 is provided.

Part (a) of FIG. 18 is a perspective view of an outer appearance of the cleaning device frame 5 when the photosensitive drum 9 is demounted, and (b) of FIG. 18 is an enlarged view of an end portion of the cleaning device frame 5. The cleaning member 14 and the second seal member B overlap with each other in a region of a width N with respect to the longitudinal direction of the cleaning member 14. As a result, when the photosensitive drum 9 is mounted to the cleaning device frame 5, the seal member B is compressed in a certain amount by the photosensitive drum 9, so that a sealing property at longitudinal both end portions of the cleaning device frame 5 is ensured. Further, a gap between the seal member B and the cleaning device frame 5 is sealed by pouring a member such as a hot-melt adhesive 90 into the gap.

Next, an actual constitution of the cleaning device frame 5 in countermeasure against the drum abrasion will be described with reference to (a) and (b) of FIG. 19, and (a) and (b) of FIG. 21.

Parts (a) and (b) of FIG. 19 are a schematic sectional view and a detailed view, respectively, of the cleaning device frame 5 when the photosensitive drum 9 is mounted to the cleaning device frame 5. Parts (a) and (b) of FIG. 21 are an outer appearance perspective view and a detailed view, respectively, of the cleaning device frame 5 when the photosensitive drum 9 is demounted.

As shown in FIG. 21, at the longitudinal both end portions of the cleaning device frame 5, the seal member B (BR, BL) and a seal bonding surface (applying surface) 31 (31R, 31L) are provided. The seal member B (BR, BL) is, in order to overlap with the seal member A, extended to the inside by a length B in with respect to a conventional width. Thus, as shown in FIG. 19, the seal member B (BR, BL) provided on the cleaning device frame 5 acts on the photosensitive drum 9 with a normal reaction F1 with respect to an arrow V direction.

This normal reaction F1 acts in a region where the seal member B (BR, BL) and the photosensitive drum 9 contact each other. At this time, the seal member B (BR, BL) is, compared with a conventional constitution, extended to the inside by the length Bin and therefore contact pressure of the seal member B to the photosensitive drum 9 is increased correspondingly to the extended region. As a result, a load on the photosensitive drum 9 with respect to the rotational direction is increased, so that a rotational torque of the photosensitive drum 9 is increased.

Therefore, a constitution in the present invention in which an increase in pressure (torque) of the seal member B (BR, BL) to the photosensitive drum 9 is suppressed while maintaining the sealing property will be described.

(Pressure Increase-suppressing Means in the Present Invention)

Parts (a) and (b) of FIG. 20 are a schematic perspective view and a detailed view, respectively, of the cleaning device frame 5 in a state in which the photosensitive drum 9 and the seal member B are demounted. Further, (a) and (b) of FIG. 12 are a schematic sectional view and an enlarged view, respectively, of the cleaning device frame 5 in a state in which the photosensitive drum 9 and the seal member B are mounted to the cleaning device frame 5 shown in FIG. 20.

As shown in FIG. 20, at each of the longitudinal both end portions of the cleaning device frame 5, the seal bonding surface 31 (31R, 31L) is, compared with the conventional constitution, extended to the inside by the length Bin, and a recessed portion 60 (60R, 60L) is formed at the extended portion. Further, as shown in FIG. 12, at the seal bonding surface 31 (31R, 31L), the recessed portion 60 is provided in a depth h in a direction perpendicular to the seal bonding surface 31.

This depth h is such a depth that after the photosensitive drum 9 is mounted to the cleaning device frame 5, the seal member B and the bottom (surface) of the recessed portion 60 do not contact each other. Here, as described above, when the photosensitive drum 9 is mounted to the cleaning device frame 5, the photosensitive drum 9 compresses the seal member B in the certain amount.

Further, at the seal bonding surface 31, in a region where the recessed portion 60 is not formed, the seal bonding surface 31 and the seal member B contact each other. For that reason, the seal member B in a compressed state by the photosensitive drum 9 acts on the photosensitive drum 9 with a normal reaction F2 with respect to an arrow V direction.

On the other hand, at the seal bonding surface 31, in a region where the recessed portion 60 is formed, the seal bonding surface and the seal member B do not contact each other. For that reason, the seal member B is not in the compressed state by the photosensitive drum 9 and therefore the contact pressure to the photosensitive drum 9 from the seal member B is released, so that the normal reaction of the seal member B to the photosensitive drum 9 is decreased. As a result, the normal reaction F2 of the seal member B to the photosensitive drum 9 becomes smaller than the above-described normal reaction F1.

That is, in the extended region, the seal member B can suppress the increase in contact pressure applied to the photosensitive drum 9. As a result, amplification of the load on the photosensitive drum 9 with respect to the rotational direction can be suppressed and therefore it is possible to suppress the increase in rotational torque of the photosensitive drum 9. Further, as described above, in order to suppress the drum abrasion, while properly accumulating the residual toner in the seal member B, the residual toner is caused to slip through the cleaning member 14 little by little.

Here, the seal bonding surface 31 is provided with the recessed portion 60 in the region where it overlaps with the seal member A with respect to the longitudinal direction. In other words, the seal bonding surface 31 is provided with the recessed portion 60 in the region located inside the position of the outside end of the seal member A and outside the position of the inside end of the seal member A with respect to the longitudinal direction. By formation of the recessed portion 60 at the seal bonding surface 31 of the seal member B, the normal reaction of the seal member B to the photosensitive drum 9 becomes small.

For that reason, the residual toner held between the photosensitive drum 9 and the seal member B can be caused to easily slip through the cleaning member 14 little by little. As a result, the toner can easily move into the region of the seal member A where the abrasion of the photosensitive drum 9 is liable to occur, so that the drum abrasion can be further suppressed. Further, the recessed portion 60 at the seal bonding surface 31 is provided at the extended portion, so that a non-extended portion has the same constitution as that of a conventional seal bonding surface and therefore a conventional sealing property can be ensured.

Incidentally, in this embodiment, the seal bonding surface 31 is provided with the recessed portion 60 but even in a constitution in which, e.g., an elastic member such as Moltopren is provided in the recessed portion 60 of the seal bonding surface 31, compared with the cleaning device frame 5 formed with a rigid member, it is possible to suppress the increase in pressure.

Incidentally, the relation between the longitudinal length Lcb of the blade 14 and the longitudinal length Ldr of the developing roller 22 is Ldr>Lcb similarly as in Embodiment 1 but is not limited thereto. As in Embodiment 2, also in the case where the relation is Ldr≤Lcb, a similar effect can be obtained by providing the recessed portion 60.

(Other Embodiments)

1) In each embodiment, the developing roller 22 may only be required to be set at a condition in which the photosensitive layer 9*b* is capable of being abraded with respect to the photosensitive drum 9. In this embodiment, in order to realize the state in which the developing roller 22 is contacted to the photosensitive drum 9 with the peripheral speed difference, the developing roller 22 including the elastic member 22*b* was, as the developer carrying member, contacted to the surface of the photosensitive drum 9. The developer carrying member does not limit its shape, its material, and the like so long as the condition in which the photosensitive layer 9*b* is abraded is satisfied.

2) The process cartridge 8 may only be required to be constituted so that the drum 9 and at least one of process means relating to the drum 9 are integrally detachably (removably) mountable to the image forming apparatus main assembly 100A.

3) Further, the image forming apparatus 100 may also be such an apparatus that the photosensitive drum 9, the charging means 10, the developing means 12 and the cleaning means 14 are directly provided in the apparatus main assembly without employing the form of the process cartridge 8. The image forming apparatus 100 may also be a monochromatic image forming apparatus.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 180273/2011 filed Aug. 22, 2011 and 097654/2012 filed Apr. 23, 2012, which are hereby incorporated by reference.

What is claimed is:

1. An electrophotographic image forming apparatus for forming an image on a recording material, comprising:

a rotatable electrophotographic photosensitive member on which a latent image is to be formed;

a rotatable developer carrying member for carrying a developer and for developing the latent image with the developer in contact with said photosensitive member;

a cleaning blade in contact with said photosensitive member for cleaning said photosensitive member;

a developer seal member, provided at an end portion of said developer carrying member, for preventing leakage of the developer; and a retaining seal member, provided at an end portion of said cleaning blade in contact with said photosensitive member, capable of retaining the developer and supplying the developer to a contact area between said photosensitive member and said developer carrying member, wherein, with respect to a longitudinal direction of said photosensitive member:

said developer seal member is disposed in a region that corresponds to another region where said cleaning blade is provided, an inside end position of said retaining seal member is located at a position that longitudinally corresponds to or is longitudinally inside an inside end position of said developer seal member, and an outside end position of said retaining seal member is located at a position that longitudinally corresponds to or is longitudinally outside an outside end position of said developer seal member.

2. The electrophotographic image forming apparatus according to claim 1, wherein when a longitudinal length in which said developer carrying member contacts said photosensitive member is Ldr and a longitudinal length in which said cleaning blade contacts said photosensitive member is Lcb, Ldr>Lcb is satisfied.

3. The electrophotographic image forming apparatus according to claim 1, wherein said retaining seal member is a cleaning member for preventing the leakage of the developer removed by said cleaning blade.

4. The electrophotographic image forming apparatus according to claim 1, wherein said retaining seal member comprises a pile fabric, a felt material or a urethane material.

5. The electrophotographic image forming apparatus according to claim 1, further comprising a holding portion for holding an end portion of said retaining seal member, wherein said retaining seal member is mounted on said holding portion, and wherein said holding portion is provided with an inclined portion which is closer to said photosensitive member at a position closer to a longitudinal end portion of the inclined portion.

6. The electrophotographic image forming apparatus according to claim 1, further comprising a cleaning device frame on which said cleaning blade and said retaining seal member are provided, wherein said cleaning device frame has a bonding surface to which said retaining seal member is bonded, and wherein said bonding surface includes a recessed portion in a region located inside a longitudinal extent of the outside end of said developer seal member and outside a longitudinal extent of the inside end position of said developer seal member with respect to the longitudinal direction.

7. The electrophotographic image forming apparatus according to claim 1, further comprising a charging roller having an end portion positioned inside an end portion of said cleaning blade with respect to the longitudinal direction of said photosensitive member.

8. The electrophotographic image forming apparatus according to claim 1, further comprising a charging roller having an end portion positioned correspondingly to said retaining seal member with respect to the longitudinal direction of said photosensitive member.

9. A process cartridge detachably mountable to an image forming apparatus main assembly of an electrophotographic image forming apparatus for forming an image on a recording material, comprising:

a rotatable electrophotographic photosensitive member on which a latent image is to be formed;

a rotatable developer carrying member for carrying a developer and for developing the latent image with the developer in contact with said photosensitive member;

a cleaning blade in contact with said photosensitive member for cleaning said photosensitive member;

a developer seal member, provided at an end portion of said developer carrying member, for preventing leakage of the developer; and a retaining seal member, provided at an end portion of said cleaning blade in contact with said photosensitive member, capable of retaining the developer and supplying the developer to a contact area between said photosensitive member and said developer carrying member, wherein, with respect to a longitudinal direction of said photosensitive member:

said developer seal member is disposed in a region that corresponds to another region where said cleaning blade is provided, an inside end position of said retaining seal member is located at a position that longitudinally corresponds to or is longitudinally inside an inside end position of said developer seal member, and an outside end position of said retaining seal member is located at a position that longitudinally corresponds to or is longitudinally outside an outside end position of said developer seal member.

10. The process cartridge according to claim 9, wherein when a longitudinal length in which said developer carrying member contacts said photosensitive member is Ldr and a longitudinal length in which said cleaning blade contacts said photosensitive member is Lcb, Ldr>Lcb is satisfied.

11. The process cartridge according to claim 9, wherein said retaining seal member is a cleaning member for preventing the leakage of the developer removed by said cleaning blade.

12. The process cartridge according to claim 9, wherein said retaining seal member comprises a pile fabric, a felt material or a urethane material.

13. The process cartridge according to claim 9, further comprising a holding portion for holding an end portion of said retaining seal member, wherein said retaining seal member is mounted on said holding portion, and wherein said holding portion is provided with an inclined portion which is closer to said photosensitive member at a position closer to a longitudinal end portion of the inclined portion.

14. The process cartridge according to claim 9, further comprising a cleaning device frame on which said cleaning blade and said retaining seal member are provided, wherein said cleaning device frame has a bonding surface to which said retaining seal member is bonded, and wherein said bonding surface includes a recessed portion in a region located inside a longitudinal extent of the outside end of said developer seal member and outside a longitudinal extent of the inside end position of said developer seal member with respect to the longitudinal direction.

15. The process cartridge according to claim 9, further comprising a charging roller having an end portion positioned inside an end portion of said cleaning blade with respect to the longitudinal direction of said photosensitive member.

16. The process cartridge according to claim 9, further comprising a charging roller having an end portion positioned correspondingly to said retaining seal member with respect to the longitudinal direction of said photosensitive member.

17. A process cartridge detachably mountable to an image forming apparatus main assembly of an electrophotographic image forming apparatus for forming an image on a recording material, comprising:

a rotatable electrophotographic photosensitive member on which a latent image is to be formed;

a rotatable developer carrying member for carrying a developer and for developing the latent image with the developer in contact with said photosensitive member;

a cleaning blade in contact with said photosensitive member for cleaning said photosensitive member;

a developer seal member, provided at an end portion of said developer carrying member, for preventing leakage of the developer; and a retaining seal member, provided at an end portion of said cleaning blade in contact with said photosensitive member, capable of retaining the developer and supplying the developer to a contact area between said photosensitive member and said developer carrying member, wherein, with respect to a longitudinal direction of said photosensitive member:

a distance from an inside end position of said retaining seal member to a center of said cleaning blade is the same as or less than a distance from an inside end position of said developer seal member and a center of said developer carrying member, and a distance from an outside end position of said retaining seal member to the center of said cleaning blade is the same as or greater than a distance from an outside end position of said developer seal member and the center of said developer carrying member.

18. An electrophotographic image forming apparatus comprising:

a main assembly; and the process cartridge according to claim 17 mountable to said main assembly.

19. The electrophotographic image forming apparatus according to claim 18, further comprising a charging roller having an end portion positioned inside an end portion of said cleaning blade with respect to the longitudinal direction of said photosensitive member.

20. The electrophotographic image forming apparatus according to claim 18, further comprising a charging roller having an end portion positioned correspondingly to said retaining seal member with respect to the longitudinal direction of said photosensitive member.

21. The process cartridge according to claim 17, further comprising a charging roller having an end portion positioned inside an end portion of said cleaning blade with respect to the longitudinal direction of said photosensitive member.

22. The process cartridge according to claim 17, further comprising a charging roller having an end portion positioned correspondingly to said retaining seal member with respect to the longitudinal direction of said photosensitive member.

* * * * *